US007536763B2

(12) United States Patent
Offerhaus

(10) Patent No.: US 7,536,763 B2
(45) Date of Patent: May 26, 2009

(54) DISPOSABLE/REUSABLE CORE ADAPTERS

(75) Inventor: Douglas Henry Offerhaus, Campbell River (CA)

(73) Assignee: Catalyst Paper Corporation, Richmond, British Columbia (CA)

( * ) Notice: Subject to any disclaimer, the term of this patent is extended or adjusted under 35 U.S.C. 154(b) by 633 days.

(21) Appl. No.: 11/406,318

(22) Filed: Apr. 19, 2006

(65) Prior Publication Data

US 2006/0185156 A1 Aug. 24, 2006

Related U.S. Application Data

(62) Division of application No. 10/950,567, filed on Sep. 28, 2004, now Pat. No. 7,210,648.

(51) Int. Cl.
*B23Q 1/00* (2006.01)

(52) U.S. Cl. ..... 29/283; 29/559; 242/572; 242/577.3; 269/48.1; 269/48.2

(58) Field of Classification Search ..... 29/798, 29/521, 522.1, 523, 559, 281.1, 283; 242/571, 242/572, 573, 573.1, 577, 577.3; 269/48.1, 269/48.2, 48.3; 279/2.01, 2.03, 2.11
See application file for complete search history.

(56) References Cited

U.S. PATENT DOCUMENTS 2,280,370 A * 4/1942 Bennett ..... 242/573.1
2,616,633 A 11/1952 Reynolds
3,115,798 A 12/1963 Donaway
3,322,361 A 5/1967 Young
3,396,918 A 8/1968 Adamson et al.
3,502,279 A 3/1970 Bundschuh et al.
3,610,643 A * 10/1971 Thompson ..... 279/2.12

(Continued)

FOREIGN PATENT DOCUMENTS

CA 2121276 10/1994

(Continued)

OTHER PUBLICATIONS

English translation of DE 19607916A1 reference above.

(Continued)

*Primary Examiner*—David P Bryant
*Assistant Examiner*—Christopher M Koehler
(74) *Attorney, Agent, or Firm*—Oyen Wiggs Green & Mutala LLP

(57) ABSTRACT

A core adapter formed as a hollow cylindrical sleeve. A plurality of apertures extend through the sleeve, parallel to the sleeve's longitudinal axis. A plurality of radial apertures are formed in the sleeve for each longitudinal aperture. Each radial aperture is perpendicular to sleeve's axis and intersects a longitudinal aperture. Studs are provided in each radial aperture, initially recessed beneath the sleeve's outer surface. The sleeve's outside diameter is sized for insertion into a 6-inch inside diameter core. The sleeve's inside diameter is the same size as a 3-inch inside diameter core. The adapter is inserted into a 6-inch core until it is flush with the end of the core. Wedge-tipped bars are driven into each of the adapter's longitudinally aligned rows of studs, and against the bottom of each stud, thereby driving the studs perpendicularly away from the sleeve's axis into the core.

13 Claims, 18 Drawing Sheets

U.S. PATENT DOCUMENTS

| | | | | |
|---|---|---|---|---|
| 3,811,635 | A | 5/1974 | Goddard | |
| 4,079,896 | A * | 3/1978 | Plach | 242/573 |
| 4,381,088 | A | 4/1983 | Bryant | |
| 4,516,786 | A | 5/1985 | Lund | |
| 4,711,406 | A | 12/1987 | Barstow | |
| 4,773,656 | A | 9/1988 | Chlupsa | |
| 5,170,960 | A * | 12/1992 | Pretto | 242/573 |
| 5,340,050 | A | 8/1994 | Renck | |
| 5,451,010 | A | 9/1995 | Heuser | |
| 5,577,686 | A | 11/1996 | Moody | |
| 5,651,511 | A | 7/1997 | Crowley et al. | |
| 5,769,352 | A | 6/1998 | Biagiotti | |
| 6,345,660 | B2 * | 2/2002 | Tharpe et al. | 156/494 |
| 6,503,008 | B2 | 1/2003 | Zevin et al. | |
| 7,007,886 | B2 * | 3/2006 | Oesterwind et al. | 242/573.7 |
| 7,175,128 | B2 * | 2/2007 | Korthauer | 242/571 |
| 7,210,648 | B2 | 5/2007 | Offerhaus | |

FOREIGN PATENT DOCUMENTS

| | | | |
|---|---|---|---|
| CA | 2121277 | | 10/1994 |
| CA | 2299107 | | 8/2000 |
| DE | 86 34 752 | U | 2/1987 |
| DE | 19607916 | A1 | 9/1996 |
| EP | 0121996 | B1 | 10/1984 |
| EP | 0704400 | A2 | 4/1996 |
| GB | 1110186 | A | 4/1968 |
| WO | 93/03992 | A | 3/1993 |
| WO | 03055778 | A1 | 7/2003 |
| WO | 2006/034566 | | 4/2006 |

OTHER PUBLICATIONS 3 photographs of core adapters used for an unknown period of time at Quebecor World Dickson gravure and offset facility, Dickson, TN.

Printouts of nine color digital photographs of paper rolls, roll cores and core adapters used since 1991 by Sonoco Products Company, Hartsville, SC.

Non-Final Office Action; U.S. Appl. No. 11/418,056; Mailed on Mar. 18, 2008.

"Paper Core Adapter", web page of SOS Service, Inc., Angola, IN, bearing 2004 copyright notice and accessible via Internet URL http://sosservice.net/paper_core_adapters.htm.

* cited by examiner 112
116
116
116

DISPOSABLE/REUSABLE CORE ADAPTERS

REFERENCE TO RELATED APPLICATION

This is a division of U.S. patent application Ser. No. 10/950,567 filed 28 Sep. 2004, which is hereby incorporated by reference.

TECHNICAL FIELD

This invention provides both disposable and reusable core adapters, either of which facilitate mounting a roll wound on a larger inside diameter core in a reel stand having core chucks designed for use with a roll wound on a core having a smaller inside diameter. For example, a paper roll wound on a nominal 6-inch (15.24 cm) inside diameter core can be mounted in a reel stand having core chucks designed for use with a paper roll wound on a nominal 3-inch (7.62 cm) diameter core.

BACKGROUND

Web material such as paper, fabric, plastic film, metal foil, etc., is commonly wound onto a core. For example, paper rolls, such as newsprint or soft nip calendered rolls, are produced by winding a paper web onto a fiber core. Newsprint roll core diameters can vary, but two are prevalent, namely (nominal) 3-inch and (nominal) 6-inch inside diameter cores. Press room reel stands are equipped with core chucks sized to fit either 3-inch or 6-inch diameter cores, but not always both. Consequently, paper mills commonly supply newsprint wound on cores sized to fit each customer's unique combination of reel stands. For example, a customer having some reel stands equipped only with 3-inch core chucks and some reel stands equipped only with 6-inch core chucks will order some rolls wound on 3-inch cores and some rolls wound on 6-inch cores. This complicates management of press room roll inventories and restricts flexible allocation of rolls to reel stands, since rolls wound on 6-inch cores cannot be mounted on reel stands equipped only with 3-inch core chucks, and rolls wound on 3-inch cores cannot be mounted on reel stands equipped only with 6-inch core chucks.

Management of paper mill roll inventories is also complex. For example, a paper mill may need to delay production, until receipt of an appropriate combination of customer orders for rolls wound on 3-inch and 6-inch cores, to match the width of the paper machine winder for efficient production of the ordered rolls. This is because most winders cannot simultaneously wind sets of rolls on different diameter cores.

Prior art 6-to-3 inch core adapters have been used in an attempt to circumvent the foregoing problems. If such adapters are fitted into each of the opposed ends of a 6-inch diameter core, a paper roll wound on that core can be mounted on a reel stand equipped only with 3-inch core chucks. This allows a paper mill to efficiently wind all rolls onto 6-inch diameter cores—customers having reel stands equipped only with 3-inch core chucks can use such adapters to mount the rolls on those reel stands. This significantly improves press room efficiency—any warehoused roll of paper can be mounted on any reel stand at any time. Moreover, larger diameter cores are preferable because they are stiffer and less susceptible to vibration as the roll unwinds, which allows higher sustained operating speeds and improved runnability in the press room. Paper mills also benefit because excess production rolls wound on 6-inch diameter cores can be sold to customers who only have reel stands equipped with 3-inch core chucks, thus helping reduce the volume of dead stock in paper mill warehouses and avoiding expensive rewinding of paper rolls from cores of one diameter onto different diameter cores.

A typical prior art adapter is formed as a cylindrical steel sleeve, with an inside diameter suitable for engaging 3-inch core chucks. A plurality of ribs extend radially from the sleeve. The ribs are sized to tightly engage the inside diameter of a 6-inch diameter paper roll core, when the adapter's ribbed end is driven into the core. Such adapters usually have a protruding end flange which extends parallel to the side of the paper roll when the adapter is driven into the core. The flange necessitates reduction of the roll's width, which is undesirable because reduced-width rolls do not fully utilize the reel stand's width capacity. The protruding flange also precludes safe stacking, on end, of rolls in which such adapters have been installed. Such prior art adapters are also heavy, unwieldily, and may not effectively engage the core chuck's fingers, potentially allowing the roll to slip on the reel stand. Furthermore, installation of such prior art core adapters in a typical press room can be laborious and time consuming.

This invention addresses the shortcomings of such prior art adapters.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense. Although the invention is described and illustrated in relation to newsprint type paper rolls, persons skilled in the art will understand that the invention is readily usable with other core-wound web materials such as fabric, plastic film, metal foil, etc.

Disposable Core Adapter

Figure 1:
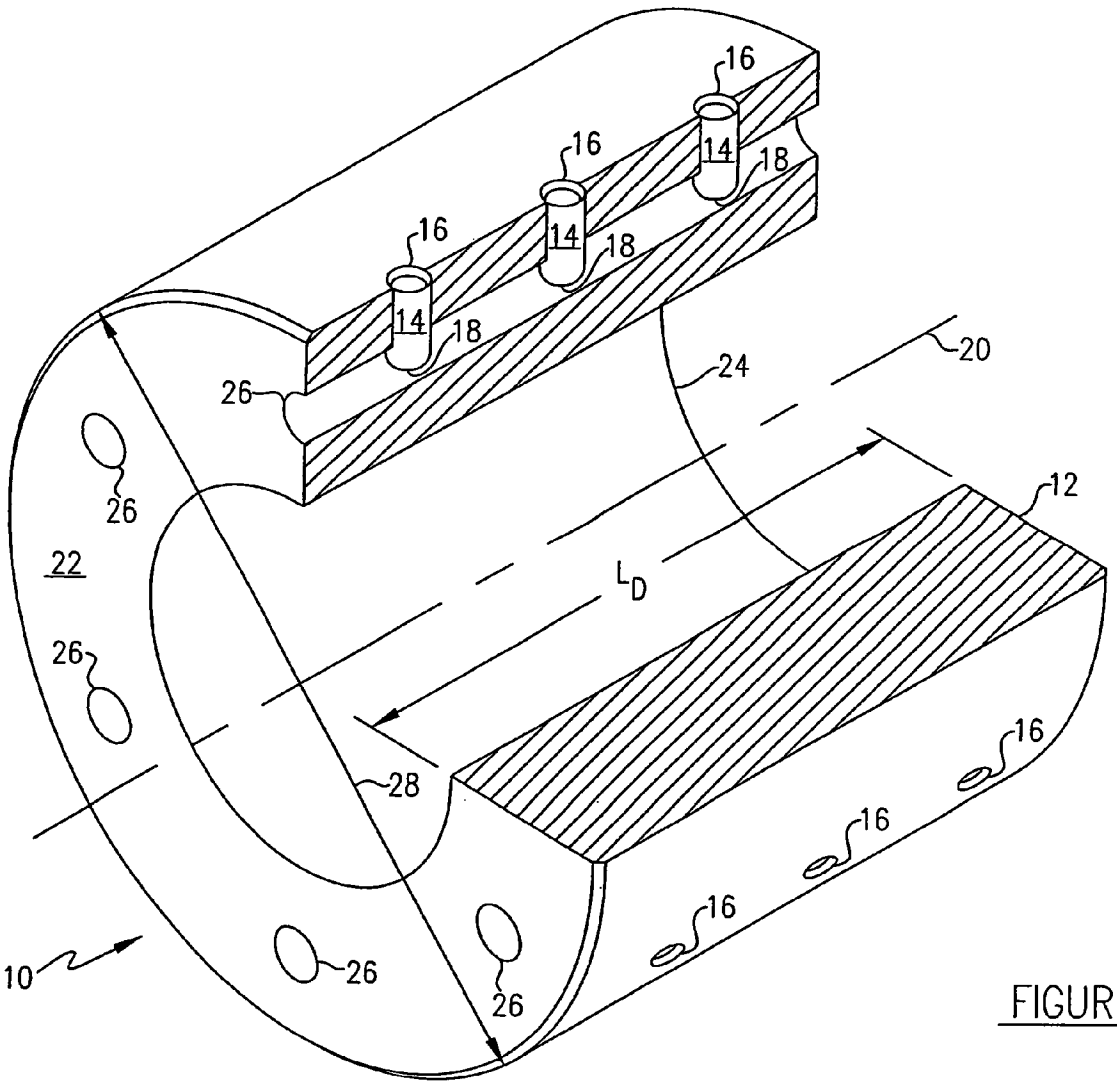
FIG. 1 is a partially sectioned isometric view of a disposable core adapter in accordance with the invention, showing the adapter's studs retracted.
Figure 2:
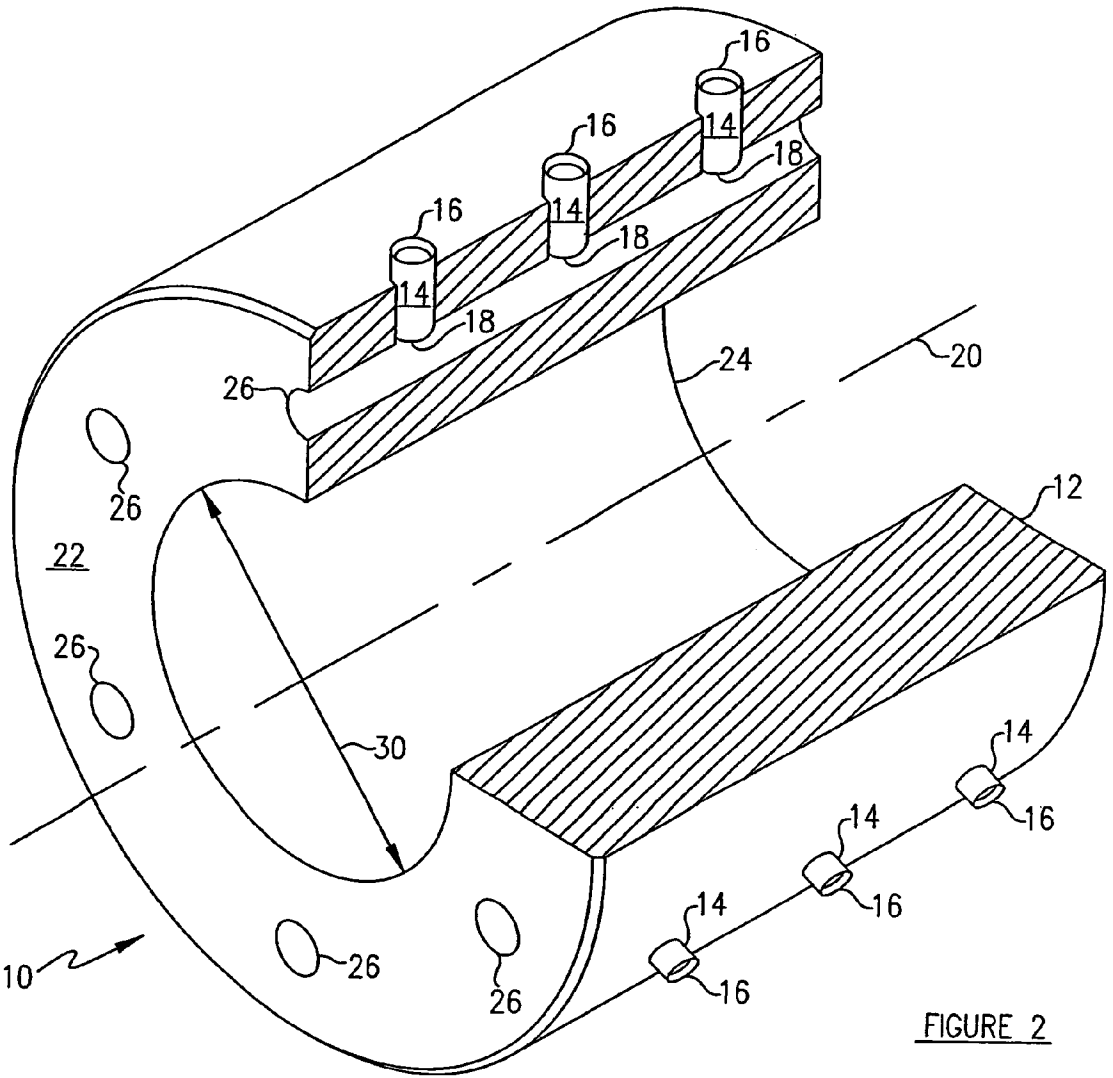
FIG. 2 shows the FIG. 1 disposable adapter with its studs extended, but does not show the adapter's wedge-tipped, hexagonally cross-sectioned bars.

FIGS. 1 and 2 depict a disposable core adapter 10 formed as a flangeless, ribless hollow cylindrical sleeve 12. Adapter 10 can be made from the same inexpensive fiber material used to make conventional paper roll cores, or made from other suitable material such as particle board, recycled plastic, rubber, etc. Such disposable adapters 10 are suitable for use in paper mills, where they can be quickly and economically installed to suit customer core size requirements, before the paper rolls are shipped to the customer.

A plurality of (e.g. eighteen) hollow-tipped tubular studs 14 are friction-fit embedded in apertures formed radially in sleeve 12. Each stud 14 has a sharp-lipped circumferential tip 16 and a rounded bottom 18. Tips 16 are initially recessed beneath sleeve 12's outer cylindrical surface, as shown in FIG. 1. Advantageously, each stud 14 is about 0.735 inches (about 1.867 cm) long with an external diameter of about 0.3125 inches (about 0.794 cm). Each stud 14's hollow tip is about 0.35 inches (about 0.89 cm) deep with an internal diameter of about 0.25 inches (about 0.635 cm).

Studs 14 are arranged in a plurality of (e.g. six) parallel rows spaced evenly and circumferentially around sleeve 12. Within each row, each stud is coplanar with one stud in each one of the other rows. A plurality of (e.g. three) studs are provided in each row, spaced evenly along the row. Each stud's longitudinal axis extends substantially perpendicular to sleeve 12's longitudinal axis 20. The outermost studs in each row are set back a suitable distance (e.g. about 1-inch, or 2.54 cm) from sleeve 12's (interchangeable) outward and inward ends 22, 24 respectively to prevent distortion of the roll's core during use of adapter 10 as explained below.

A longitudinal, cylindrical aperture 26 is formed through sleeve 12 beneath each row of studs 14, substantially parallel to axis 20 and intersecting the inner ends of the radial apertures in which each stud in the row is embedded. Each aperture 26 is located so that, when studs 14 are initially recessed within sleeve 12 as shown in FIG. 1, the rounded bottom 18 of each stud in the row above the aperture extends partially into the aperture, without extending completely across the aperture.

Disposable adapter sleeve 12's outside diameter 28 (FIG. 1) is sized for light friction-fit insertion into a standard 6-inch inside diameter paper roll core. Sleeve 12's inside diameter 30 (FIG. 2) is sized to the same tolerances as a standard 3-inch inside diameter paper roll core. Diameters 28, 30 define notional cylinders which are coaxial about axis 20. Disposable adapter 10 can have any reasonable length "$L_D$" (FIG. 1—e.g. about 5 inches, or 12.7 cm) to accommodate different core chuck designs. As explained below, a wedge-tipped, hexagonally cross-sectioned bar (not shown in FIG. 1 or 2) is provided for each one of sleeve 12's apertures 26. As will be seen, the bars ultimately form part of adapter 10.

Disposable Core Adapter Insertion Tool

Figure 3:
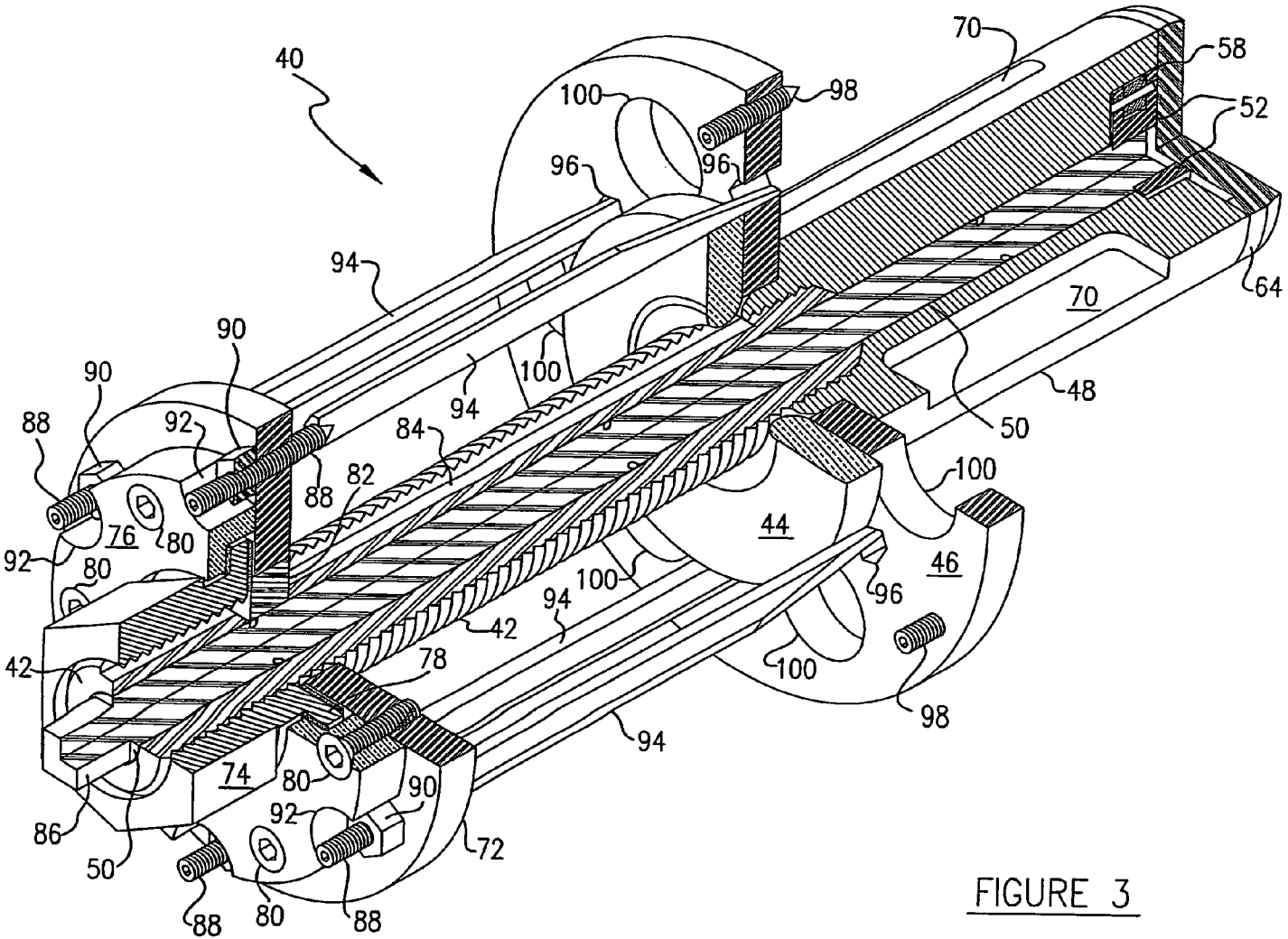
FIG. 3 is a partially sectioned isometric view of a tool for inserting the disposable core adapter into a roll core.

FIG. 3 depicts a tool 40 for inserting disposable core adapter 10 into a paper roll core (not shown in FIG. 3). As used herein, "inward" means toward the right, as viewed in FIG. 3; and "outward" means toward the left, as viewed in FIG. 3. Tool 40 has a longitudinally apertured, externally threaded rod 42 which extends through central apertures in each of Delrin™ spacer plate 44 and stop flange 46 (spacer plate 44 is optional). The inward end of rod 42 is threaded into a mating aperture provided in the outward end of adapter mounting mandrel 48 and welded or otherwise fastened to stop flange 46. The outside diameter of mandrel 48 is slightly less than sleeve 12's inside diameter 30 to permit easily slidable mounting of adapter 10 on mandrel 48.

Figure 4:
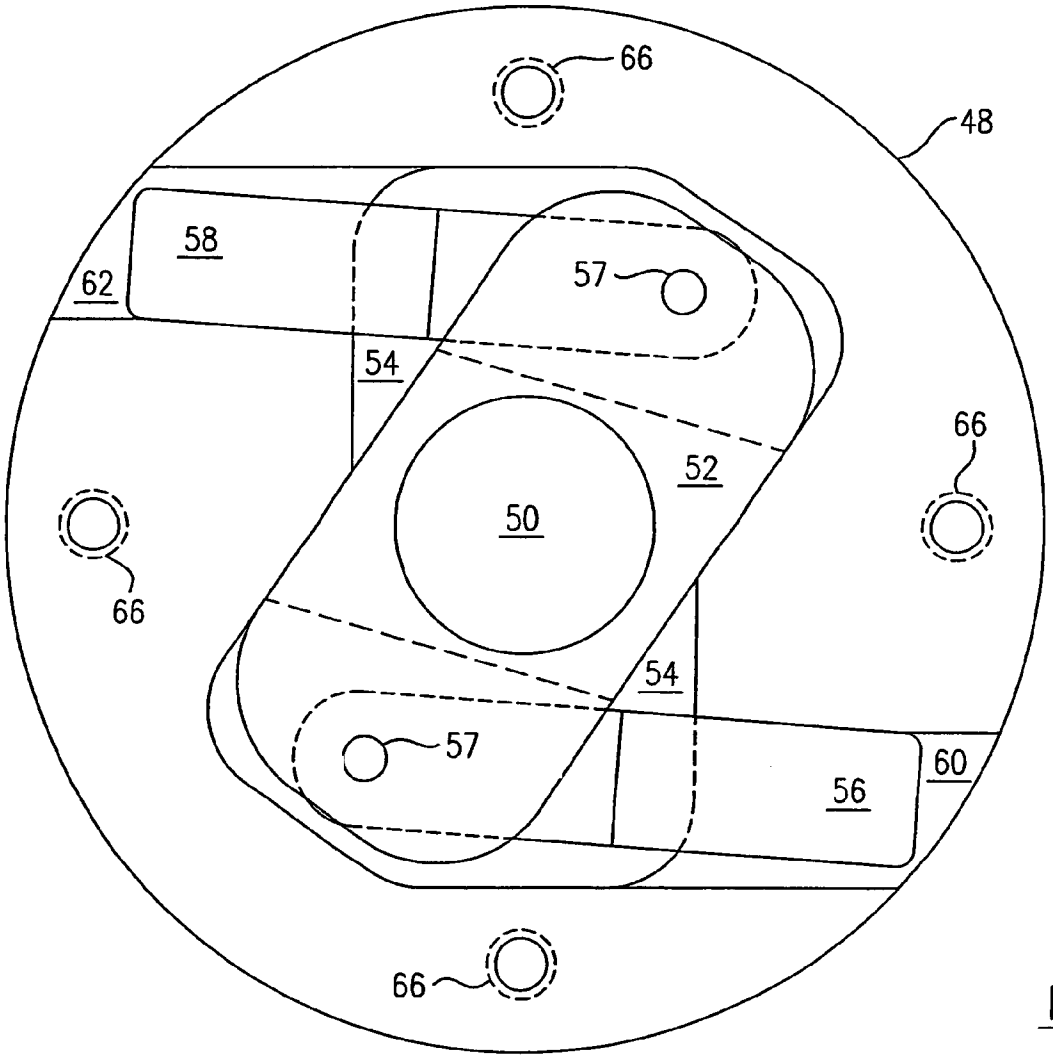
FIG. 4 is an inward end elevation view, on an enlarged scale, of the tool depicted in FIG. 3, with the end cap removed and the locking pins retracted.
Figure 5:
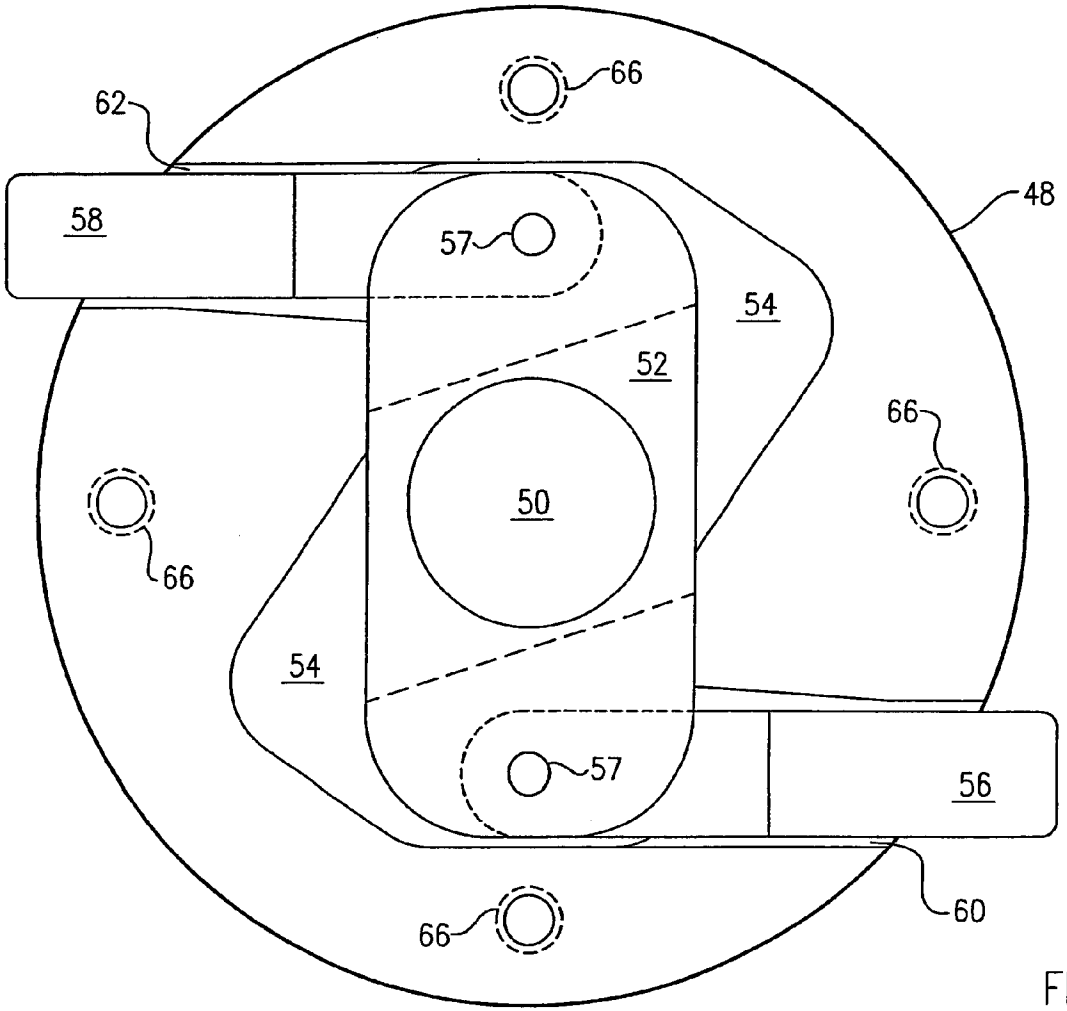
FIG. 5 is an inward end elevation view, on an enlarged scale, of tool depicted in FIG. 3, with the end cap removed and the locking pins extended.

Lock arm shaft 50 is rotatably mounted in and extends through rod 42's central longitudinal aperture. Lock arm shaft 50 projects from the inward end of rod 42 and extends through mandrel 48. As best seen in FIGS. 4 and 5, the inward end of lock arm shaft 50 is fixed to locking pin arm 52, which extends within chamber 54 machined in the inward end of mandrel 48. Locking pins 56, 58 are pivotally attached, by pivot pins 57, to opposed ends of locking pin arm 52 and extend, respectively, into apertures 60, 62 machined in the inward end of mandrel 48. Apertures 60, 62 intersect chamber 54. Lock arm shaft 50 is selectably rotated as explained below to move locking pin arm 52 into the position shown in FIG. 4 in which locking pins 56, 58 are retracted within mandrel 48; or, to move arm 52 into the position shown in FIG. 5 in which locking pins 56, 58 project from mandrel 48. Locking pins 56, 58 have wide, flat outward faces with radiused edges. Mandrel 48 is sized so that its longitudinal displacement between the inward face of stop flange 46 and the outward edges of locking pins 56, 58 is slightly greater than the length "$L_D$" (FIG. 1) of disposable adapter 10. O-rings surround shaft 50 at spaced intervals, to provide friction-fit engagement between rod 42 and shaft 50 and resist loosening of shaft 50 when tool 40 is operated as explained below.

End cap 64 (FIG. 3) is fastened to mandrel 48 by machine screws (not shown) which threadably engage apertures 66 (FIGS. 4 and 5) in mandrel 48. Optional weight-reduction channels 70 (FIG. 3) can be machined in mandrel 48. End cap 64 is made sufficiently thick (e.g. about 0.5 inches, or about 1.27 cm) to be capable of securely retaining locking pins 56, 58 when adapter 10 is driven into a paper roll core as explained below.

The outward end of rod 42 extends through a central keyway aperture in drive flange 72 and is threaded into drive nut 74. Keeper plate 76 is diametrically split into two halves which are fitted over drive nut 74's capture flange 78 and fastened to drive flange 72 by machine screws 80. Key 82 extends into drive flange 72's keyway aperture and into external keyway 84 machined in rod 42, maintaining alignment of drive flange 72 relative to stop flange 46 when drive nut 74 is rotated or counter-rotated as explained below. The squared outward end 86 of lock arm shaft 50 projects outwardly through rod 42's outward end.

Set screws 88 are threadably mounted in and extend through apertures machined in drive flange 72. One set screw 88 is provided for each one of sleeve 12's apertures 26. Nuts 90 fasten set screws 88 against the outward face of drive flange 72 to fix the displacement between the inward face of drive flange 72 and the pointed tip of each set screw 88 (that displacement preferably equaling the combined thickness of spacer plate 44 and stop flange 46). Recesses 92 machined in keeper plate 76 prevent obstruction of set screws 88 and nuts 90. The circle (not shown) used to locate the apertures machined in drive flange 72 to receive set screws 88 is the same as the circle (not shown) used to locate sleeve 12's apertures 26. The circumferential displacement around the circle of the set screw apertures machined in drive flange 72 is the same as the circumferential displacement around the circle of sleeve 12's apertures 26.

A wedge-tipped, hexagonally cross-sectioned bar 94 is provided for each one of set screws 88 (and thus for each one of sleeve 12's apertures 26). As will be seen, bars 94 ultimately form part of adapter 10, not part of tool 40, but it is convenient to describe bars 94 here. The wedge tip on each bar 94 has a smooth surface finish to reduce friction and is machined to gradually merge into one of the bar's flat hexagonal sides. The outward ends of bars 94 are centrally, conically recessed to receive the pointed tip of a corresponding one of set screws 88. The inward end of each bar 94 is preferably rounded to prevent the bar from digging into the non-apertured portion of adapter 10 during installation. The inward (i.e. wedge-tipped) ends of each bar 94 extend through a corresponding one of hexagonal apertures 96 machined in stop flange 46. The circle (not shown) used to locate apertures 96 is the same as the circle (not shown) used to locate sleeve 12's apertures 26. The circumferential displacement around the circle of apertures 96 is the same as the circumferential displacement around the circle of sleeve 12's apertures 26. Consequently, any one of stop flange apertures 96 is coaxially alignable with any one of the sleeve 12's apertures 26. When rod 42 is attached to stop flange 46 as aforesaid, care is taken to maintain coaxial alignment of each one of apertures 96 with a corresponding one of the apertures machined in drive flange 72 to receive set screws 88. Each one of sleeve 12's apertures 26 is diametrically sized for snug-fit passage of one of bars 94 through the aperture 26, as explained below. A plurality of (e.g. three) circumferentially spaced set screws 98 are threadably mounted in and extend through apertures machined in stop flange 46. Optional weight-reduction apertures 100 can be machined in stop flange 46. Optional spacer plate 44 assists in guiding bars 94 through apertures 96 when drive nut 74 is rotated or counter-rotated as explained below. Spacer plate 44 also serves as a cushioned depth stop, preventing insertion of bars 94 too deeply into sleeve 12's apertures 26.

Installation of Disposable Core Adapter

In operation, the wedge-tipped inward end of each one of bars 94 is fitted into but not completely through a corresponding one of apertures 96 in stop flange 46, care being taken to face each bar's sloped wedge surface radially toward the outer circumferential rim of drive flange 72. The conical recess in the outward end of each bar 94 is fitted over the pointed tip of a corresponding one of set screws 88. Disposable core adapter 10 (with studs 14 retracted as shown in FIG. 1) is then slidably fitted over mandrel 48 to align each one of apertures 26 over a corresponding wedge-tipped inward end of one of bars 94; and to position one of adapter 10's ends 22, 24 (those ends being interchangeable) flush against the inward face of stop flange 46. A wrench is then used to rotate lock arm shaft 50's squared outward end 86 counter-clockwise (as viewed from the left side of FIG. 3). Such rotation of lock arm shaft 50 rotates locking pin arm 52 counter-clockwise (as viewed in FIGS. 4 and 5), moving locking pin arm 52 and locking pins 56, 58 into the position shown in FIG. 5 in which locking pins 56, 58 project from mandrel 48, thereby snugly capturing disposable adapter 10 between stop flange 46 and locking pins 56, 58. The radiused edges of locking pins 56, 58 ease movement of the locking pins over adapter 10's inward end 24, reducing potential jamming of the locking pins against the adapter. The locking pins' wide, flat outward faces bear securely against the adapter's inward end without indenting that end when the adapter is driven into a paper roll core as explained below.

Figure 15A:
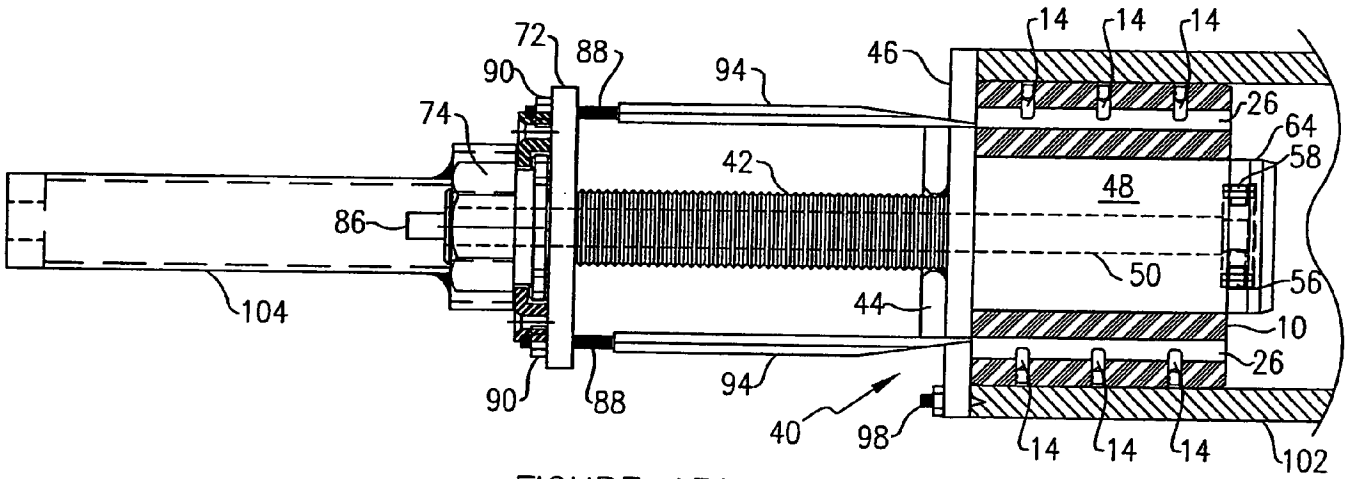
FIG. 15A is a schematic, partially sectioned, side elevation assembly view of the FIG. 3 disposable adapter insertion tool engaging one end of a paper roll after insertion of a disposable core adapter into the roll's core, showing the insertion tool positioned to commence driving the disposable adapter's studs into the core.

As shown in FIG. 15A, the inward end of disposable core adapter insertion tool 40 (i.e. the end on which disposable core adapter 10 is captively mounted as aforesaid) is then inserted into one end of 6-inch paper roll core 102, until the inward face of stop flange 46 circumferentially surrounding adapter 10 is flush against the outward end of core 102. This action forces the pointed tips of set screws 98 into core 102, preventing rotation of tool 40 and disposable core adapter 10 relative to core 102. Locking pins 56, 58 brace adapter 10's inward end, limiting the depth to which adapter 10 can be axially inserted into core 102. One end of a deep socket 104 is then fitted over drive nut 74. The socket's opposite end is coupled to an impact wrench (not shown). The impact wrench is actuated to rotate drive nut 74 so as to threadably advance drive nut 74 along rod 42 toward the rod's inward end (i.e. toward the right, as viewed in FIG. 15A). Since drive nut 74's capture flange 78 is enclosed between drive flange 72 and keeper plate 76, such advancement of drive nut 74 advances drive flange 72 and keeper plate 76 along rod 42, toward the rod's inward end. More particularly, such advancement of drive nut 74 simultaneously drives each one of bars 94 through a corresponding one of stop flange 46's apertures 96 and into a corresponding one of adapter 10's apertures 26. The aforementioned engagement of key 82 within drive flange 72's keyway aperture and within rod 42's keyway 84 maintains alignment of drive flange 72 relative to stop flange 46 as bars 94 are driven into apertures 42.

Figure 15B:
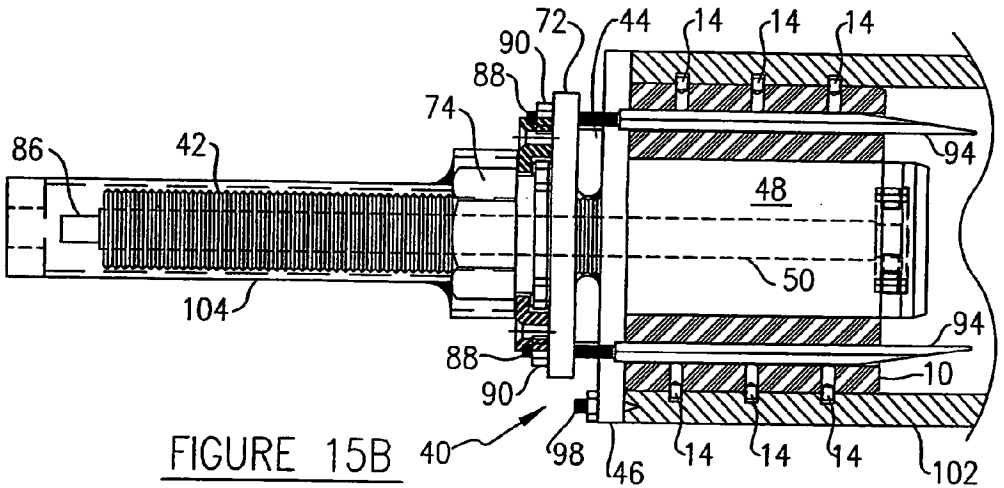
FIG. 15B depicts the FIG. 15A apparatus after actuation of the disposable adapter insertion tool to drive the disposable adapter's studs into the core.

When the wedge-tipped inward end of a bar 94 reaches the rounded bottom 18 of the outwardmost stud 14 within one of apertures 26, the wedge tip slides easily beneath rounded bottom 18. As bar 94 is driven further into aperture 26, the wedge tip is forced against rounded bottom 18, driving stud 14 substantially perpendicularly away from adapter 10's longitudinal axis 20. This in turn drives stud 14's hollow, sharp-lipped tip 16 into core 102. Operation of the impact wrench is continued to simultaneously drive each bar 94 completely into a corresponding one of apertures 26, until the bars' outward ends are flush with whichever one of adapter 10's interchangeable ends 22, 24 is positioned against stop flange 46. (Such flushness is achieved by preadjusting set screws 88 as aforesaid so that the displacement between the inward face of drive flange 72 and the pointed tip of each set screw 88 equals the combined thickness of spacer plate 44 and stop flange 46). The studs 14 in each row are thus successively driven into core 102, from the retracted position shown in FIGS. 1 and 15A into the extended position shown in FIGS. 2 and 15B. The studs' penetration depth into core 102 is determined by the width of bar 94 between any opposed pair of the bar's flat faces, thus avoiding over-penetration of the studs which could distort the outer surface of core 102. As previously explained, within each row, each stud is coplanar with one stud in each one of the other rows. Accordingly, simultaneous driving of bars 94 into apertures 26 successively drives each group of coplanar studs simultaneously into core 102, thereby maintaining concentric alignment of adapter 10 within core 102 to prevent off-axis rotation of core 102 during high speed unwinding of the roll wound on core 102.

A wrench is then used to rotate lock arm shaft 50's squared outward end 86 clockwise (as viewed from the left side of FIG. 3). Such rotation of lock arm shaft 50 rotates locking pin arm 52 clockwise (as viewed in FIGS. 4 and 5), moving locking pin arm 52 and locking pins 56, 58 into the position shown in FIG. 4 in which locking pins 56, 58 are retracted within mandrel 48. Disposable core adapter insertion tool 40 is then withdrawn from core 102, leaving disposable adapter 10 and bars 94 within core 102. Another disposable adapter 10 and another set of bars 94 are then fitted onto tool 40 and inserted into the opposite end (not shown) of core 102. That adapter's studs are then driven into core 102, as described above.

When driven into core 102 as aforesaid, studs 14 robustly couple adapter 10 to core 102, so as to withstand core chuck axial thrust loads and resist acceleration and deceleration torques applied to the paper roll during typical operation of a press room reel stand. One of bars 94 remains inside each one of adapter 10's apertures 26, with one of the bar's flat faces butted against the bottom ends 18 of each stud 14 in the row of studs above that bar, preventing retraction of studs 14 from core 102 as the paper roll is unwound from core 102. Bar 94's hexagonal shape, and the aforementioned diametric sizing of sleeve 12's apertures 26 for snug-fit passage of bars 94, resists rotational movement of bar 94 as it is driven into aperture 26 and during unwinding of the paper roll, maintaining one of the bar's flat faces against the underside of the corresponding row of studs.

Because disposable sleeve 12 is flangeless, no protrusions remain after adapter 10 is installed in core 102, so the paper roll's width is unaffected by adapter 10. Paper rolls in which disposable adapters 10 have been installed can also be safely stacked on end. Disposable core adapter insertion tool 40 facilitates fast, efficient installation of disposable core adapters 10. Tool 40's simultaneous, symmetric engagement of studs 14 ensures concentric installation of adapter 10 within core 102. Unlike prior art adapters which must be recovered from the spent core after the paper roll is unwound, disposable adapter 10 (including bars 94) is discarded with the spent core, avoiding potentially expensive, time consuming adapter recovery procedures.

Reusable Core Adapter

FIGS. 6, 7, 8A and 8B depict a reusable core adapter 110 formed as a flangeless, ribless hollow cylindrical sleeve 112 from a resilient material such as Delrin™ synthetic resinous plastic, available from E. I. du Pont De Nemours and Company, Wilmington, Del. Such reusable adapters are suitable for use in press rooms, where they can be efficiently and economically reused as explained below.

Figure 6:
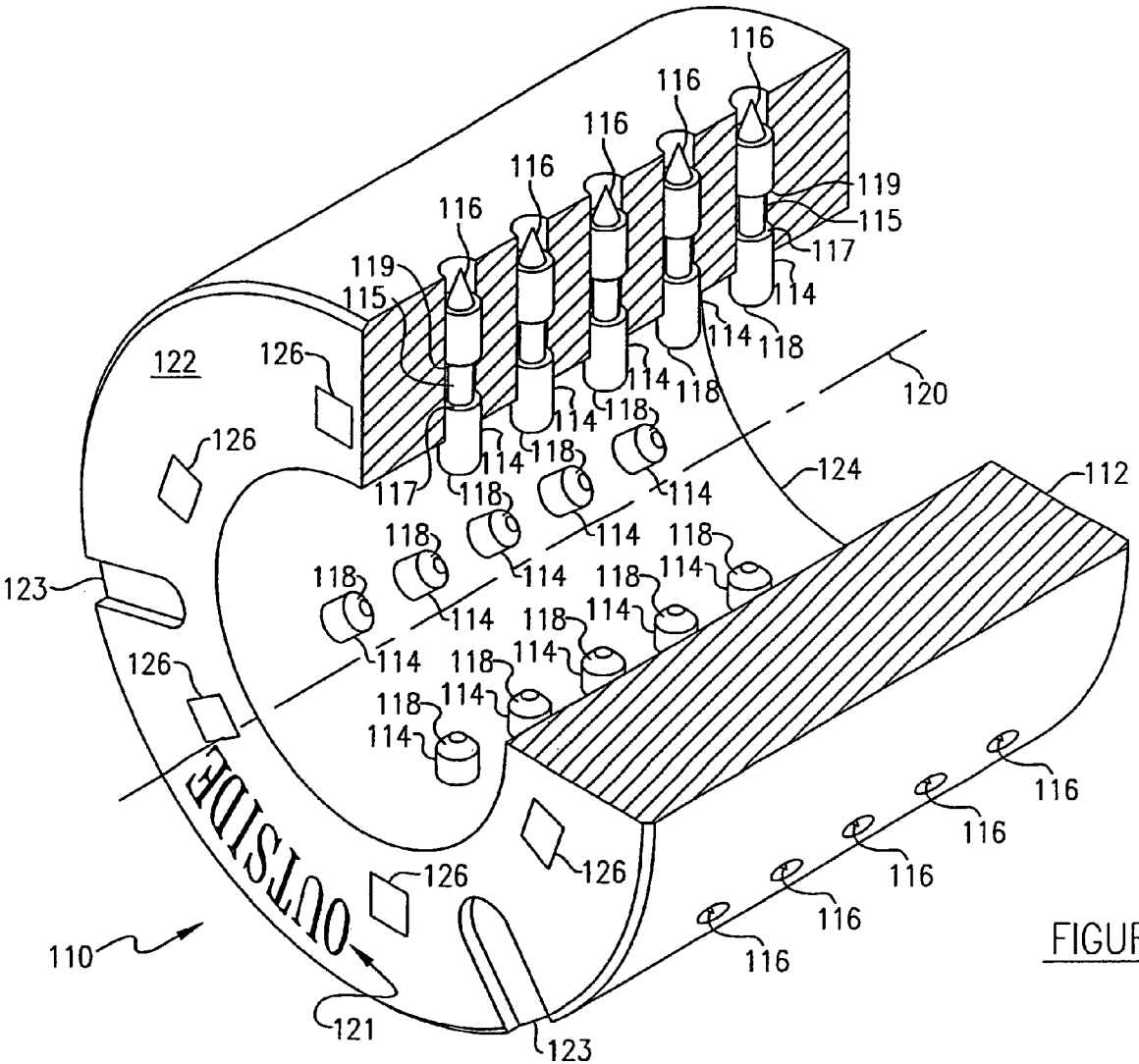
FIG. 6 is a partially sectioned isometric view of a reusable core adapter in accordance with the invention, showing the adapter's studs retracted.

A plurality of (e.g. thirty) steel studs 114 are friction-fit embedded in apertures 113 (FIGS. 8A and 8B) formed radially in sleeve 112. Each stud 114 has a circular cross-section, a tapered (e.g. conical) spiked tip 116, a rounded bottom 118, and a central circumferential groove 115 extending between lower and upper annular rims 117, 119. Tips 116 are initially recessed beneath sleeve 112's outer cylindrical surface so that bottoms 118 project into sleeve 112's hollow core, as shown in FIG. 6. Advantageously, each stud 114 has an overall length of about 1.77 inches (about 4.5 cm) and an external diameter of about 0.125 inches (about 0.3175 cm). Each stud 114's conical tip is about 0.3 inches (about 0.762 cm) long. Groove 115 is about 0.4 inches (about 1.016 cm) long and about 0.188 inches (about 0.478 cm) in diameter.

Studs 114 are arranged in a plurality of (e.g. six) parallel rows spaced evenly and circumferentially around sleeve 112. Within each row, each stud is coplanar with one stud in each one of the other rows. A plurality of (e.g. five) studs are provided in each row, spaced evenly along the row. Each stud's longitudinal axis extends substantially perpendicular to sleeve 112's longitudinal axis 120. The outermost studs in each row are set back a suitable distance (e.g. about 1-inch) from sleeve 112's outward end 122 to prevent distortion of the roll's core during use of adapter 110 as explained below. Advantageously, studs 114 are heat treated to extend their durability and longevity. Outward end 122 is clearly labelled "OUTSIDE," as indicated at 121, during manufacture of adapter 110, for example by molding the label wording into end 122. Such labelling facilitates correct mounting of adapter 110 on reusable core adapter insertion tool 140 as explained below. Pry bar slots 123 are optionally formed in outward end 122 to facilitate removal of adapter 110 from reusable core adapter removal tool 240 (described below), if adapter 110 becomes jammed on tool 240.

Figure 7:
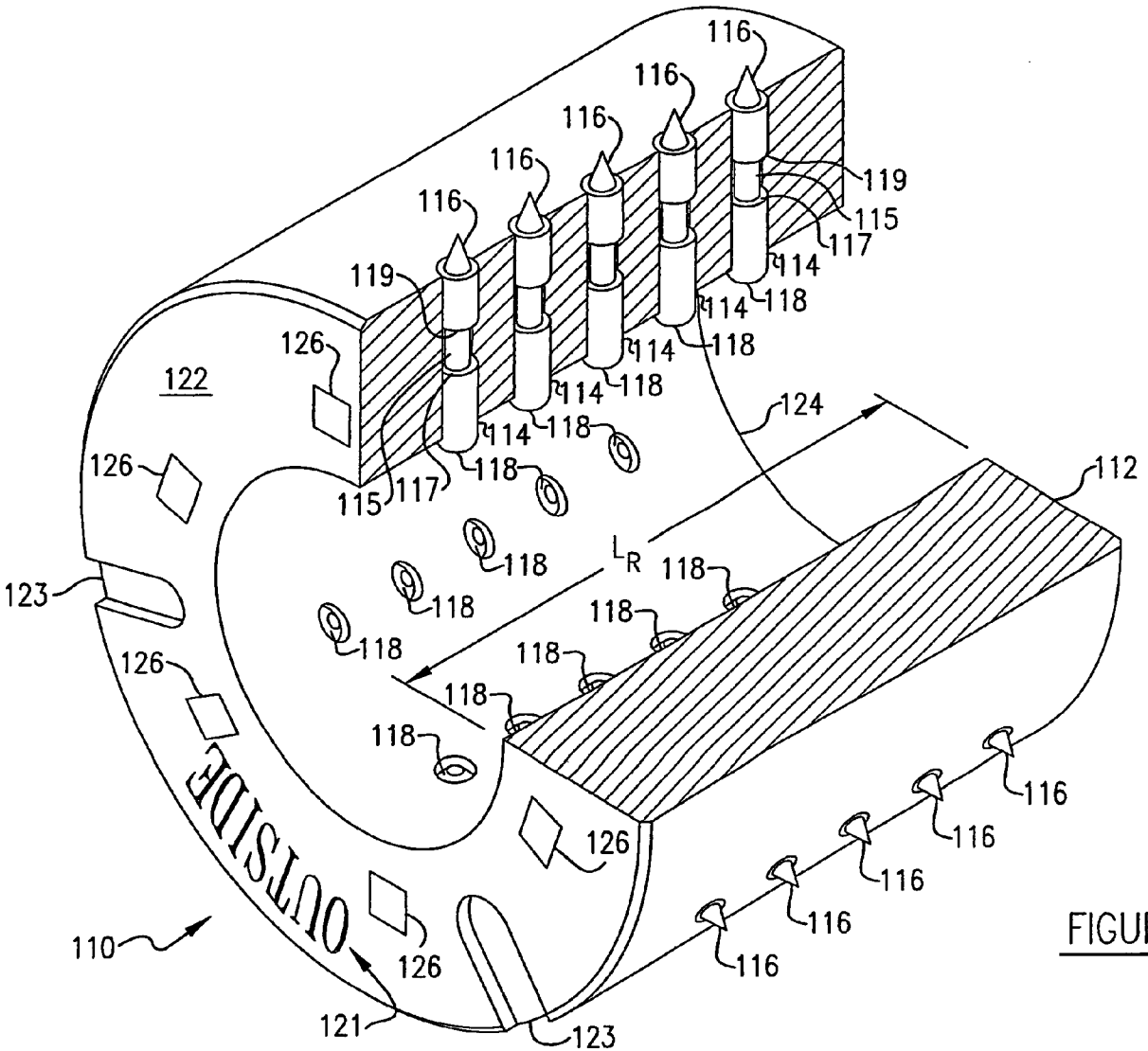
FIG. 7 shows the FIG. 6 reusable adapter with its studs extended.
Figure 8A:
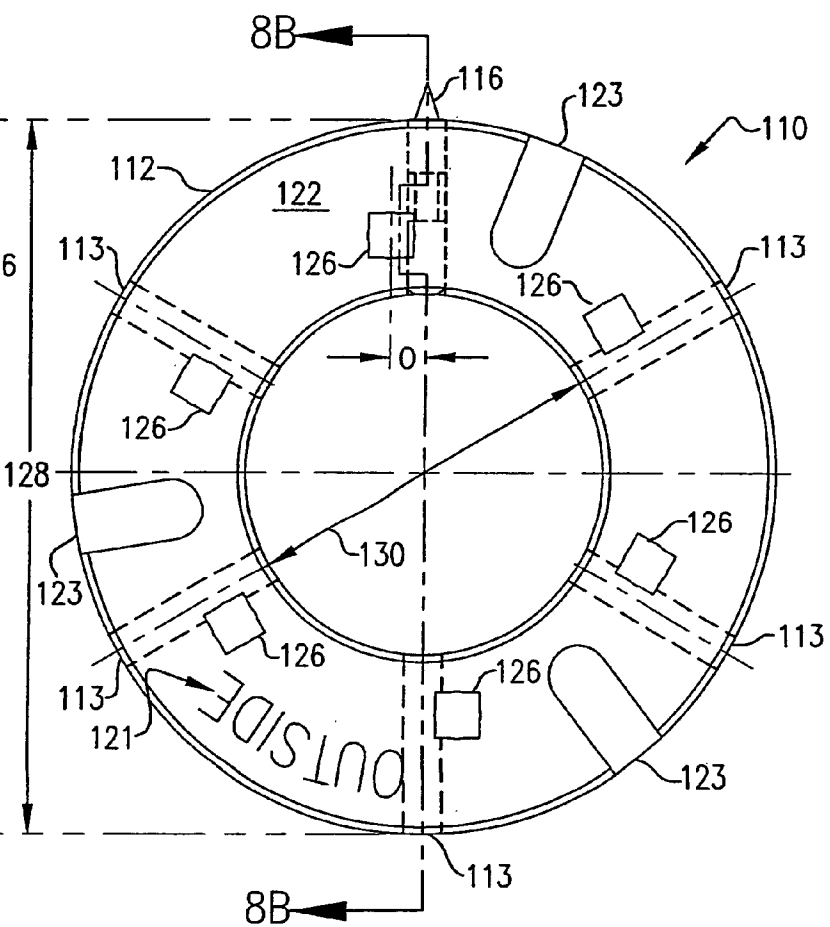
FIG. 8A is an outside end elevation view of the FIGS. 6 and 7 reusable adapter, showing one row of studs in the extended position.
Figure 8B:
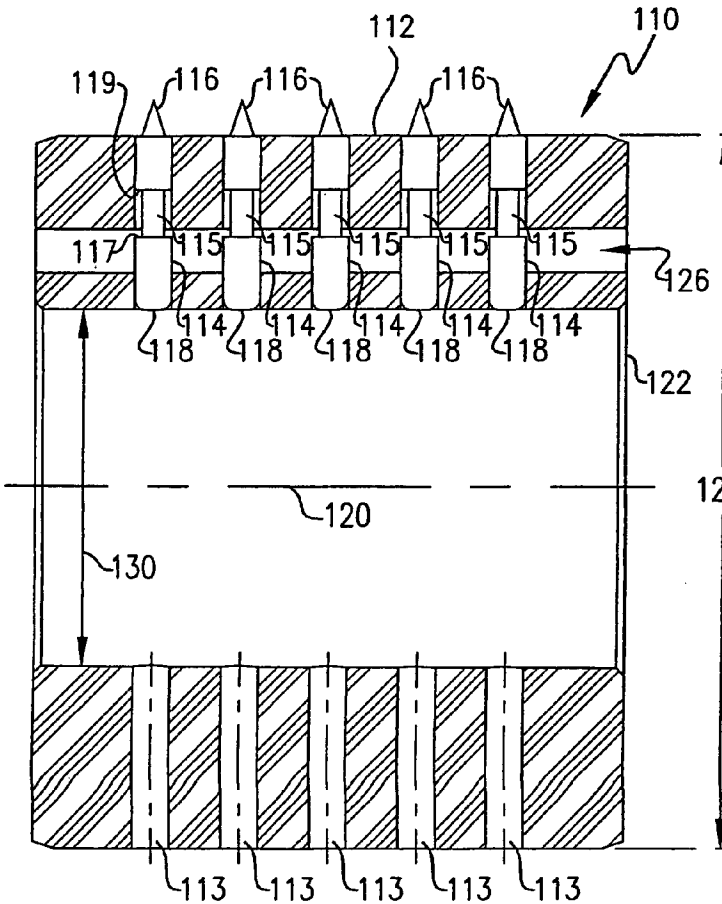
FIG. 8B is a section view taken with respect to line 8B-8B shown in FIG. 8A.

A longitudinal, rectangular cross-sectioned aperture 126 is formed through sleeve 112 adjacent each row of studs 114, substantially parallel to axis 120 and intersecting the apertures 113 in which each stud in the row is embedded. As best seen in FIG. 8A, each aperture 126 is offset by a displacement "O" relative to a notional plane containing the longitudinal axes of each stud in the row of studs adjacent that aperture; and the aperture's two side walls are substantially parallel to that plane. Each aperture 126 is located so that, when studs 114 are extended from sleeve 12 as shown in FIGS. 7 and 8B, aperture 126 partially intersects the circumferential groove 115 of each stud in the row.

Reusable adapter sleeve 112's outside diameter 128 (FIGS. 8A and 8B) is sized for light friction-fit, non-adhesive insertion into a standard 6-inch inside diameter paper roll core. Reusable adapter sleeve 112's inside diameter 130 is sized to the same tolerances as a standard 3-inch inside diameter paper roll core. Reusable adapter 110 can have any reasonable length (e.g. about 5 inches) to accommodate different core chuck designs.

Reusable Core Adapter Insertion Tool

Figure 9:
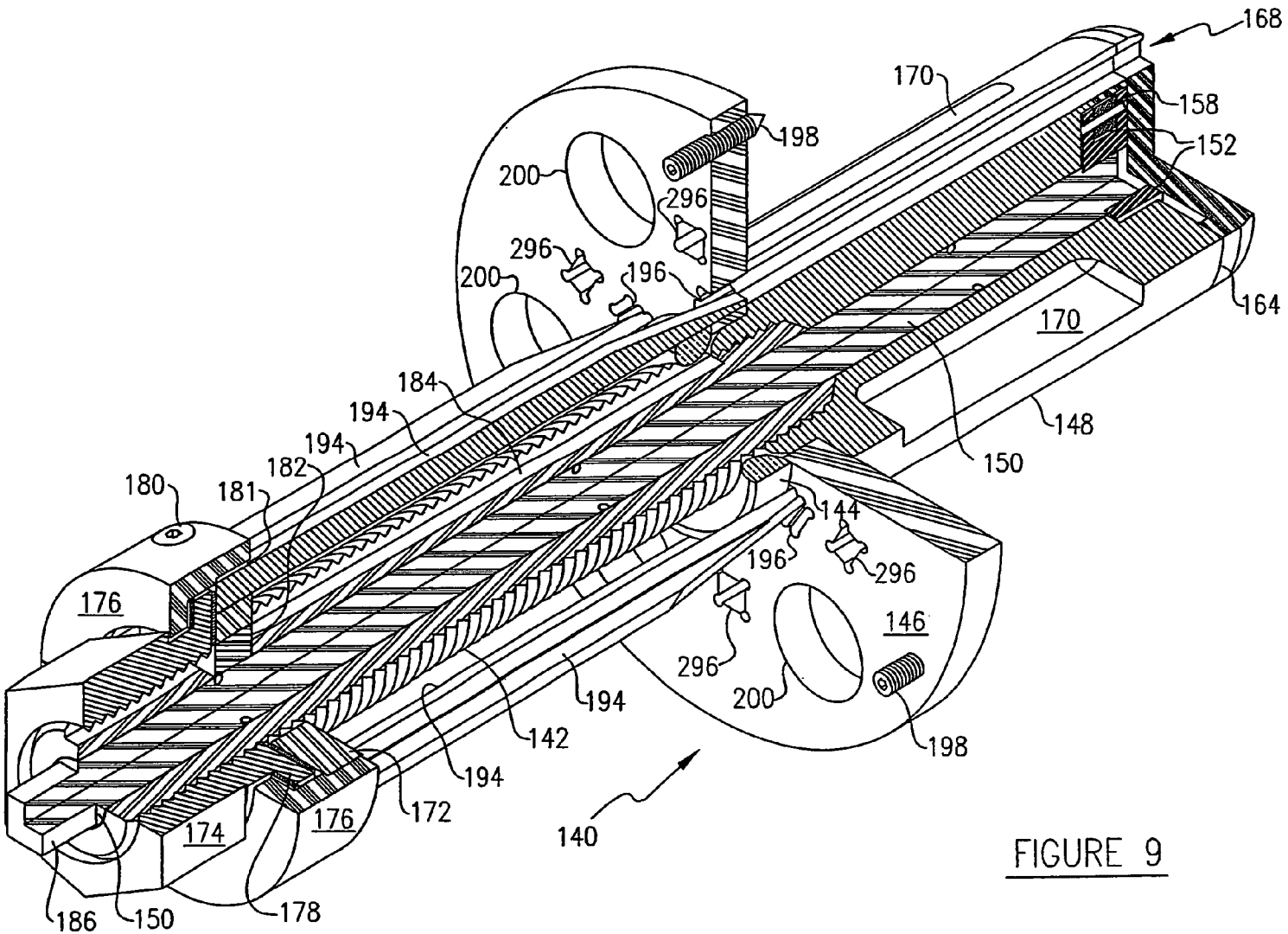
FIG. 9 is a partially sectioned isometric view of a tool for inserting the reusable core adapter into a roll core.

FIG. 9 depicts a tool 140 for inserting reusable core adapter 110 into a paper roll core (not shown in FIG. 9). As used herein, "inward" means toward the right, as viewed in FIG. 9; and "outward" means toward the left, as viewed in FIG. 9. Tool 140 has a longitudinally apertured, externally threaded rod 142 which extends through central apertures in each of Delrin™ spacer plate 144 and stop flange 146 (spacer plate 144 is optional). The inward end of rod 142 is threaded into the outward end of adapter mounting mandrel 148 and welded or otherwise fastened to stop flange 146. The outside diameter of mandrel 148 is slightly less than sleeve 112's inside diameter 130 to permit easily slidable mounting of adapter 110 on mandrel 148.

Figure 11:
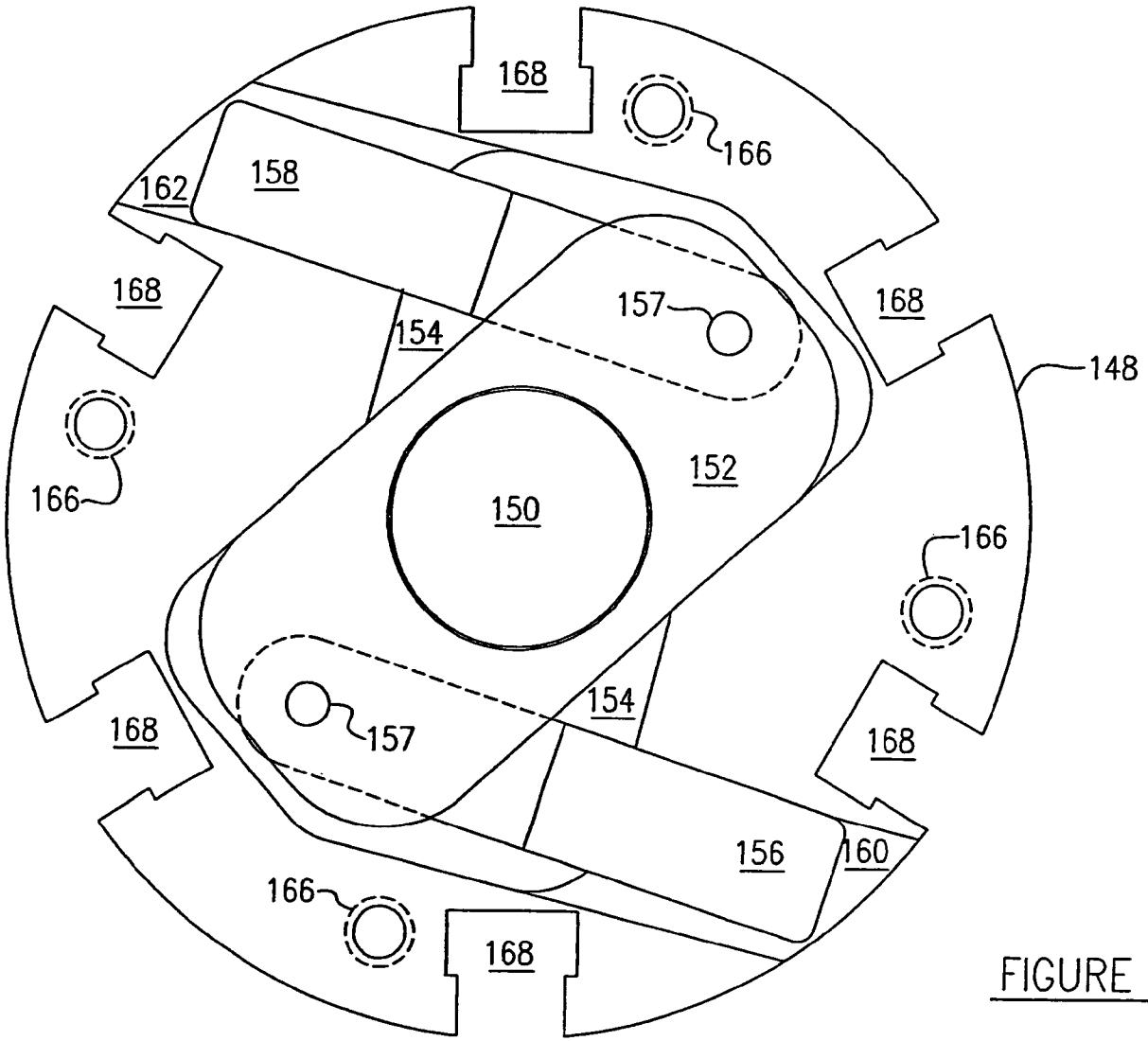
FIG. 11 is an inward end elevation view, on an enlarged scale, of either one of the tools depicted in FIG. 9 or 10, with the end cap removed and the locking pins retracted.
Figure 12:
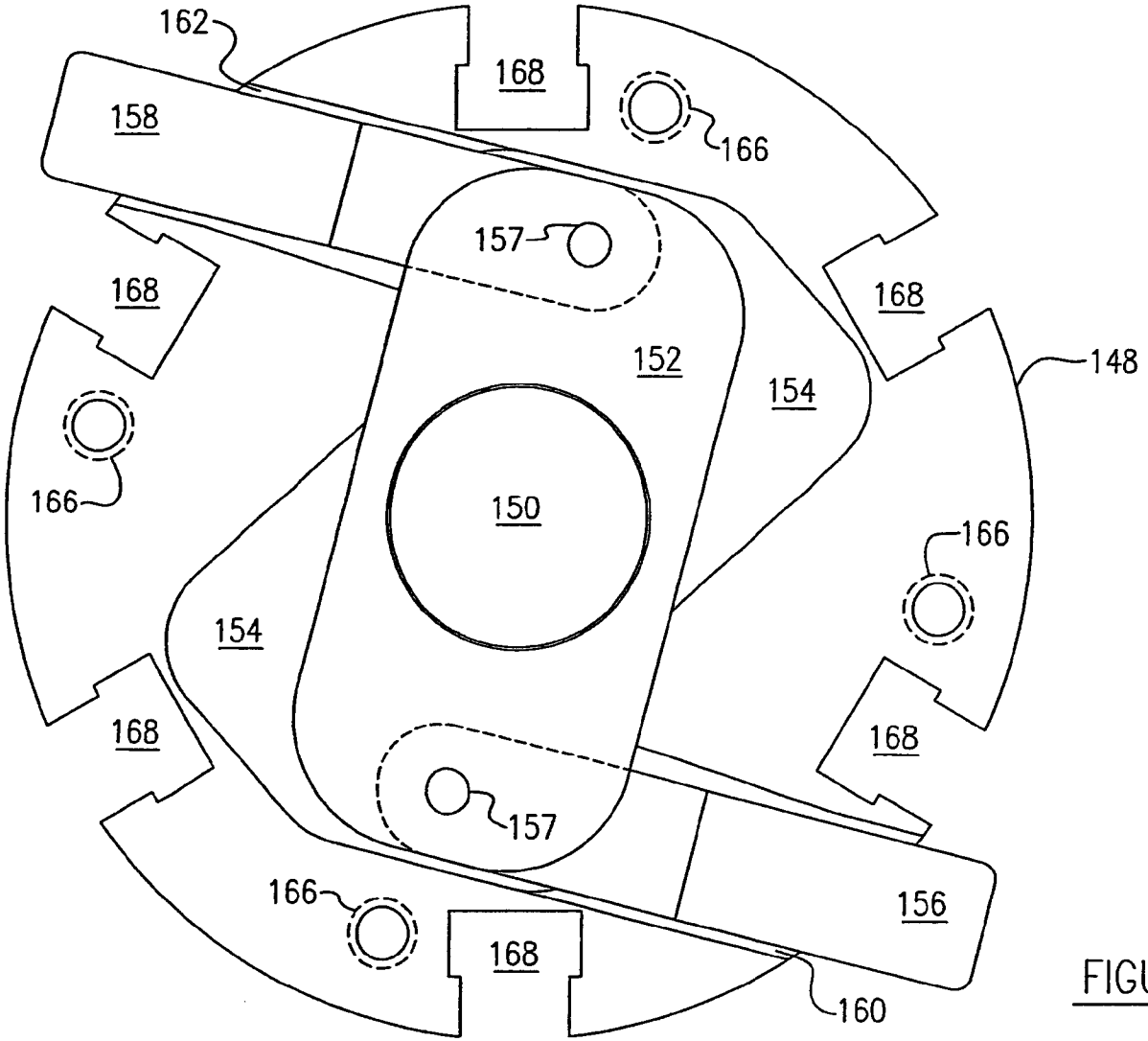
FIG. 12 is an inward end elevation view, on an enlarged scale, of either one of the tools depicted in FIG. 9 or 10, with the end cap removed and the locking pins extended.

Lock arm shaft 150 is rotatably mounted in and extends through rod 142's central longitudinal aperture. Lock arm shaft 150 projects from the inward end of rod 142 and extends through mandrel 148. As best seen in FIGS. 11 and 12, the inward end of lock arm shaft 150 is fixed to locking pin arm 152 which extends within chamber 154 machined in the inward end of mandrel 148. Locking pins 156, 158 are pivotally attached, by pivot pins 157, to opposed ends of locking pin arm 152 and extend, respectively, into apertures 160, 162 machined in the inward end of mandrel 148. Apertures 160, 162 intersect chamber 154. Lock arm shaft 150 is selectably rotated as explained below to move locking pin arm 152 into the position shown in FIG. 11 in which locking pins 156, 158 are retracted within mandrel 148; or, to move arm 152 into the position shown in FIG. 12 in which locking pins 156, 158 project from mandrel 148. Locking pins 156, 158 have wide, flat outward faces with radiused edges. Mandrel 148 is sized so that its longitudinal displacement between the inward face of stop flange 146 and the outward edges of locking pins 156, 158 is slightly greater than the length "$L_R$" (FIG. 7) of reusable adapter 110. O-rings surround shaft 150 at spaced intervals, to provide friction-fit engagement between rod 142 and shaft 150 and resist loosening of shaft 150 when tool 140 is operated as explained below.

End cap 164 (FIG. 9) is fastened to mandrel 148 by machine screws (not shown) which threadably engage apertures 166 (FIGS. 11 and 12) in mandrel 148. A plurality of circumferentially spaced, longitudinally extending channels 168 are machined in mandrel 148. One channel 168 is provided for each row of studs 114 in adapter 110. Each channel 168 has an inverted-T cross-sectional shape, as seen in FIGS. 11 and 12. Optional weight-reduction channels 170 (FIG. 9) can be machined in mandrel 148. End cap 164 is made sufficiently thick (e.g. about 0.5 inches, or about 1.27 cm) to be capable of securely retaining locking pins 156, 158 when adapter 110 is driven into a paper roll core as explained below.

Figure 13:
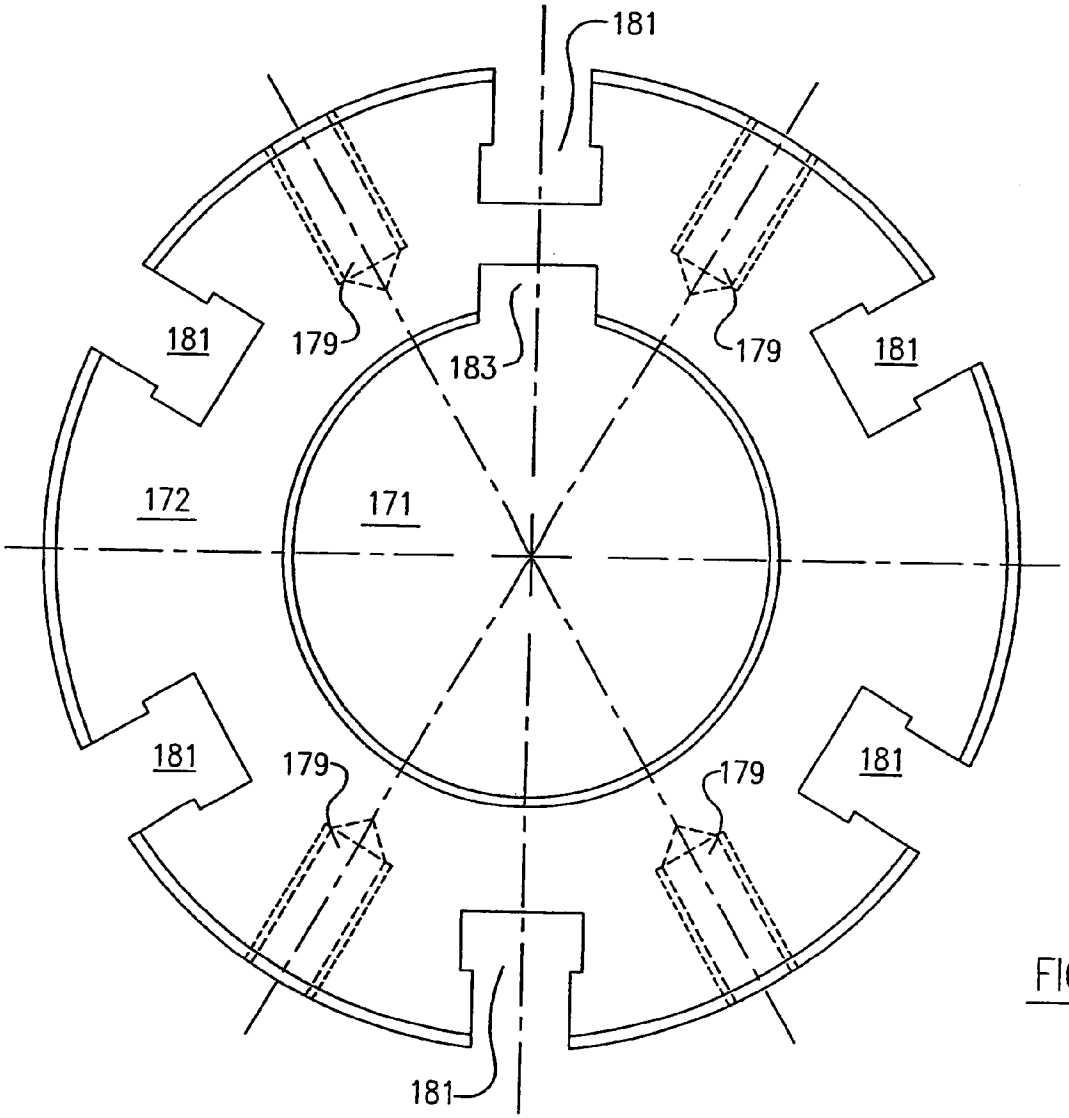
FIG. 13 is an inward end elevation view of the drive flange portion of the FIG. 9 tool.

The outward end of rod 142 extends through a central keyway aperture 171 (FIG. 13) in drive flange 172 and is threaded into drive nut 174. Keeper plate 176 is diametrically split into two halves which are fitted over drive nut 174's capture flange 178 and fastened to drive flange 172 by machine screws 180 which threadably engage apertures 179 (FIG. 13) in drive flange 172. A plurality of circumferentially spaced slots 181 are machined in drive flange 172. One slot 181 is provided for each row of studs 114 provided in sleeve 112. Each slot 181 has an inverted-T cross-sectional shape, matching that of channels 168. The circle (not shown) used to locate channels 168 machined in mandrel 148 is the same as the circle (not shown) used to machine slots 181 in drive flange 172. The circumferential displacement around the circle of channels 168 machined in mandrel 148 is the same as the circumferential displacement around the circle of slots 181 machined in drive flange 172. Key 182 extends into drive flange 172's keyway aperture 183 and into external keyway 184 machined in rod 142, maintaining alignment of drive flange 172 relative to stop flange 146 when drive nut 174 is rotated or counter-rotated as explained below. The squared outward end 186 of lock arm shaft 150 projects outwardly through rod 142's outward end.

A wedge-tipped bar 194 having an inverted-T cross-sectional shape matching that of channels 168 and slots 181 is provided for each one of slots 181 (and thus for each row of studs 114 provided in sleeve 112). The wedge face on each bar 194 has a smooth surface finish to reduce friction and is machined to gradually merge into the bar's narrow top face, opposite the bar's wider bottom face. Advantageously, the wedge face on each bar 194 is heat treated to increase surface hardness for wear resistance, while preserving ductility of the remainder of each bar 194 to inhibit breakage. The inward end of each bar 194 is preferably rounded to prevent the bar from digging into the non-apertured portion of adapter 110 during installation. The outward end of each bar 194 is welded or otherwise fastened into one of drive flange 172's slots 181, care being taken to align bars 194 substantially perpendicular to the inward face of drive flange 172, with each bar's sloped wedge surface facing radially toward the outer circumferential rim of drive flange 172 and the bar's wider bottom face facing radially away from the outer circumferential rim of drive flange 172. The inward (i.e. wedge-tipped) ends of each bar 194 extend through a corresponding one of rectangular apertures 196 machined in stop flange 146. The circle (not shown) used to locate apertures 196 is the same as the circle (not shown) used to locate channels 168 machined in mandrel 148. The circumferential displacement around the circle of apertures 196 is the same as the circumferential displacement around the circle of channels 168 machined in mandrel 148. Consequently, any one of apertures 196 is coaxially alignable with any one of channels 168. When rod 142 is attached to stop flange 146 as aforesaid, care is taken to maintain coaxial alignment of each one of apertures 196 with a corresponding one of drive flange 172's slots 181. A plurality of (e.g. three) circumferentially spaced set screws 198 are threadably mounted in and extend through apertures machined in stop flange 146. Optional weight-reduction apertures 200 can be machined in stop flange 146. Optional spacer plate 144 assists in guiding bars 194 through apertures 196 when drive nut 174 is rotated or counter-rotated as explained below. Spacer plate 144 also serves as a cushioned depth stop for drive flange 172.

Reusable Core Adapter Removal Tool

Figure 10:
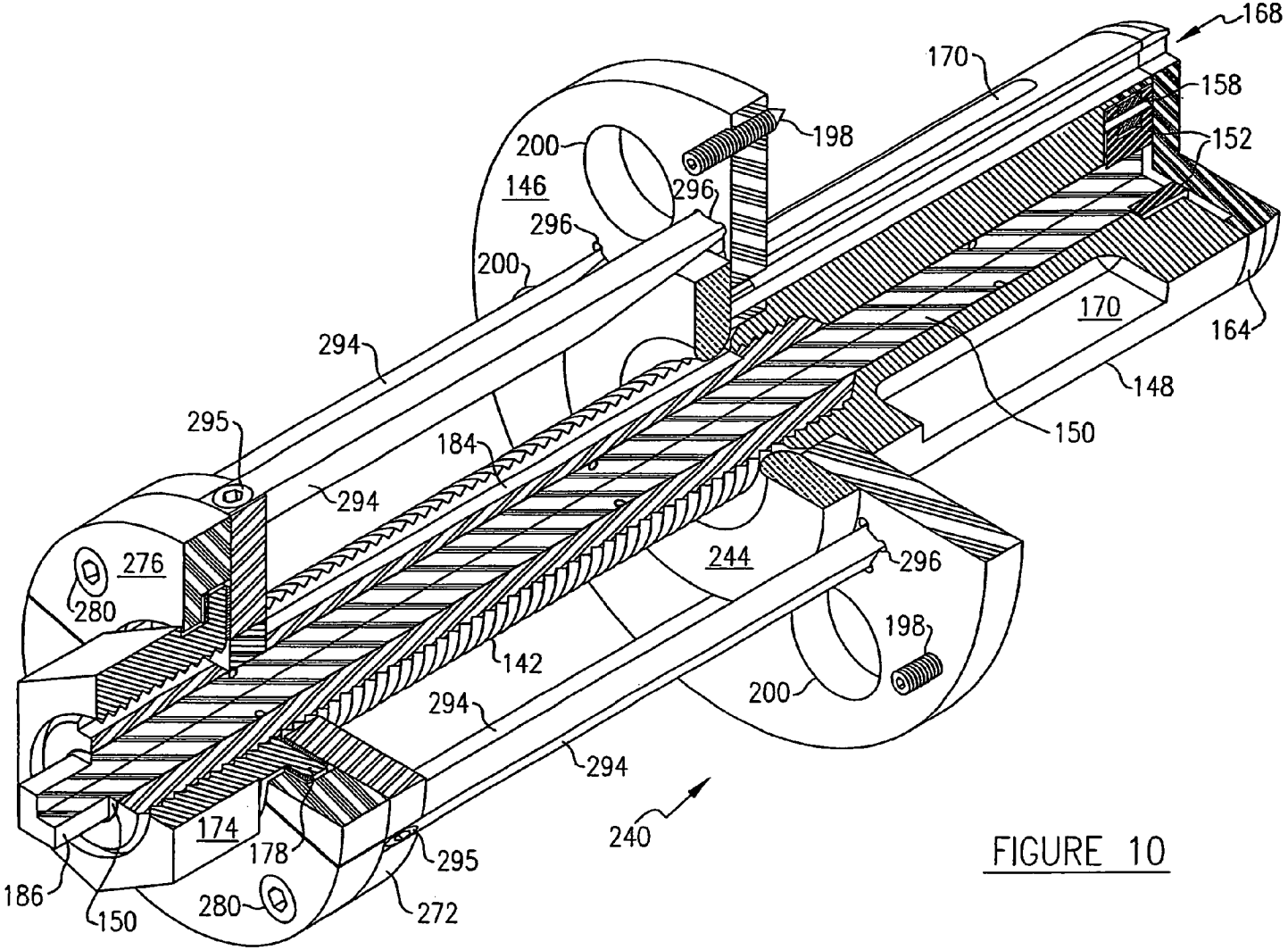
FIG. 10 is a partially sectioned isometric view of a tool for removing the reusable core adapter from a roll core.

FIG. 10 depicts a tool 240 for removing from a paper roll core (not shown in FIG. 10) a reusable core adapter 110 previously inserted into the core by tool 140. Comparison of FIGS. 9 and 10 will reveal that tools 140, 240 are structurally similar. Components which are common to tools 140, 240 bear the same reference numerals in FIGS. 9 and 10 and need not be described further. As used herein, "inward" means toward the right, as viewed in FIG. 10; and "outward" means toward the left, as viewed in FIG. 10.

Figure 14:
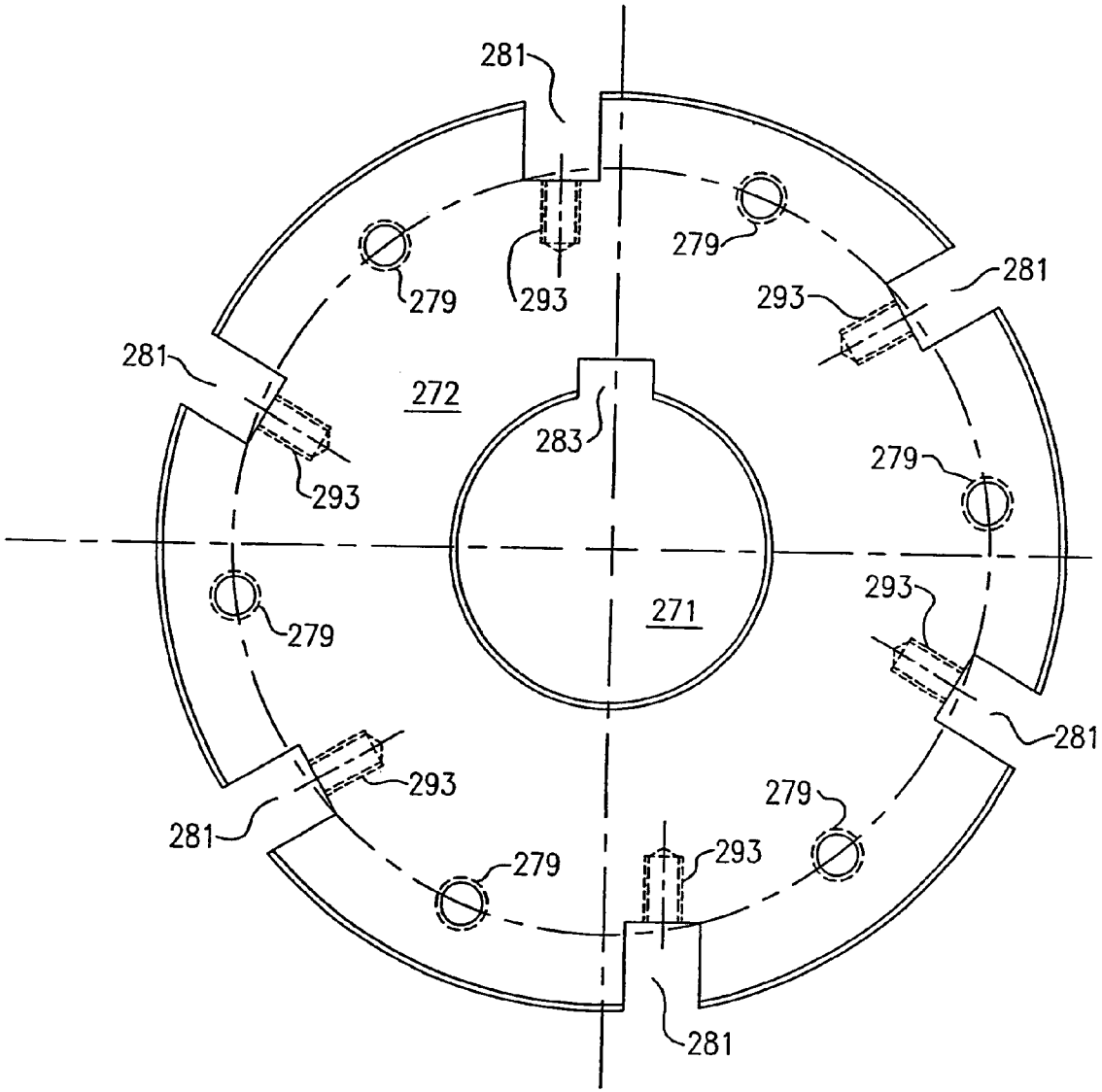
FIG. 14 is an inward end elevation view of the drive flange portion of the FIG. 10 tool.

Keeper plate 276 is diametrically split into two halves which are fitted over drive nut 174's capture flange 178 and fastened to drive flange 272 by machine screws 280 which threadably engage apertures 279 (FIG. 14) in drive flange 272. A plurality of circumferentially spaced slots 281 are machined in drive flange 272. One slot 281 is provided for each row of studs 114 provided in sleeve 112. Each slot 281 has a rectangular cross-sectional shape. The circle (not shown) used to locate slots 281 machined in drive flange 172 is the same as the circle (not shown) used to locate apertures 126 formed in adapter 110. The circumferential displacement of slots 281 around the circle is the same as the circumferential displacement of apertures 126 around the circle. Key 182 extends into drive flange 272's keyway aperture 283 and into external keyway 184 machined in rod 142, maintaining alignment of drive flange 272 relative to stop flange 146 when drive nut 174 is rotated or counter-rotated as explained below.

A wedge-tipped bar 294 having a rectangular cross-sectional shape matching that of apertures 126 and slots 281 is provided for each one of slots 181 (and thus for each for each row of studs 114 provided in sleeve 112). The wedge tip on each bar 294 has a smooth surface finish to reduce friction and is machined to gradually merge into one of the bar's flat sides. Advantageously, the wedge tip on each bar 294 is heat treated to increase surface hardness for wear resistance, while preserving ductility of the remainder of each bar 294 to inhibit breakage. The inward end of each bar 294 is preferably rounded to prevent the bar from digging into the non-apertured portion of adapter 110 during installation. The outward end of each bar 294 is fastened into one of drive flange 272's slots 281 by one of machine screws 295 which threadably engage apertures 293 (FIG. 14), care being taken to align bars 294 substantially perpendicular to the inward face of drive flange 272, with each bar's sloped wedge surface facing radially away from the outer circumferential rim of drive flange 272. The inward (i.e. wedge-tipped) ends of each bar 294 extend through a corresponding one of rectangular apertures 296 machined in stop flange 146. The circle (not shown) used to locate apertures 296 is the same as the circle (not shown) used to locate sleeve 112's apertures 126. The circumferential displacement of apertures 296 around the circle is the same as the circumferential displacement around the circle of apertures 126 formed through sleeve 112. Consequently, any one of apertures 296 is coaxially alignable with any one of the sleeve 112's apertures 126. When rod 142 is attached to stop flange 146 as aforesaid, care is taken to maintain coaxial alignment of each one of apertures 296 with a corresponding one of drive flange 272's slots 281. Each aperture 126 in sleeve 112 is diametrically sized for snug-fit passage of one of bars 294 through aperture 126 as explained below. Optional spacer plate 244 assists in guiding bars 294 through apertures 296 when drive nut 174 is rotated or counter-rotated as explained below. Spacer plate 244 also serves as a cushioned stop for drive flange 272.

Installation of Reusable Core Adapter

In operation, a reusable core adapter 110 (with studs 114 retracted as shown in FIG. 6) is slidably fitted over tool 140's mandrel 148 by aligning the bottom ends 118 in each row of studs 114 within a corresponding one of channels 168 to position adapter 110's outward end 122 (i.e. the end bearing "OUTSIDE" label 121) flush against the inward face of stop flange 146. A wrench is then used to rotate lock arm shaft 150's squared outward end 186 counter-clockwise (as viewed from the left side of FIG. 9). Such rotation of lock arm shaft 150 rotates locking pin arm 152 counter-clockwise (as viewed in FIGS. 11 and 12), moving locking pin arm 152 and locking pins 156, 158 into the position shown in FIG. 12 in which locking pins 156, 158 project from mandrel 148, thereby snugly capturing reusable adapter 110 between stop flange 146 and locking pins 156, 158. The radiused edges of locking pins 156, 158 ease movement of the locking pins over adapter 110's inward end 124, reducing potential jamming of the locking pins against the adapter. The locking pins' wide, flat outward faces bear securely against the adapter's inward end without indenting that end when the adapter is driven into a paper roll core as explained below.

Figure 16:
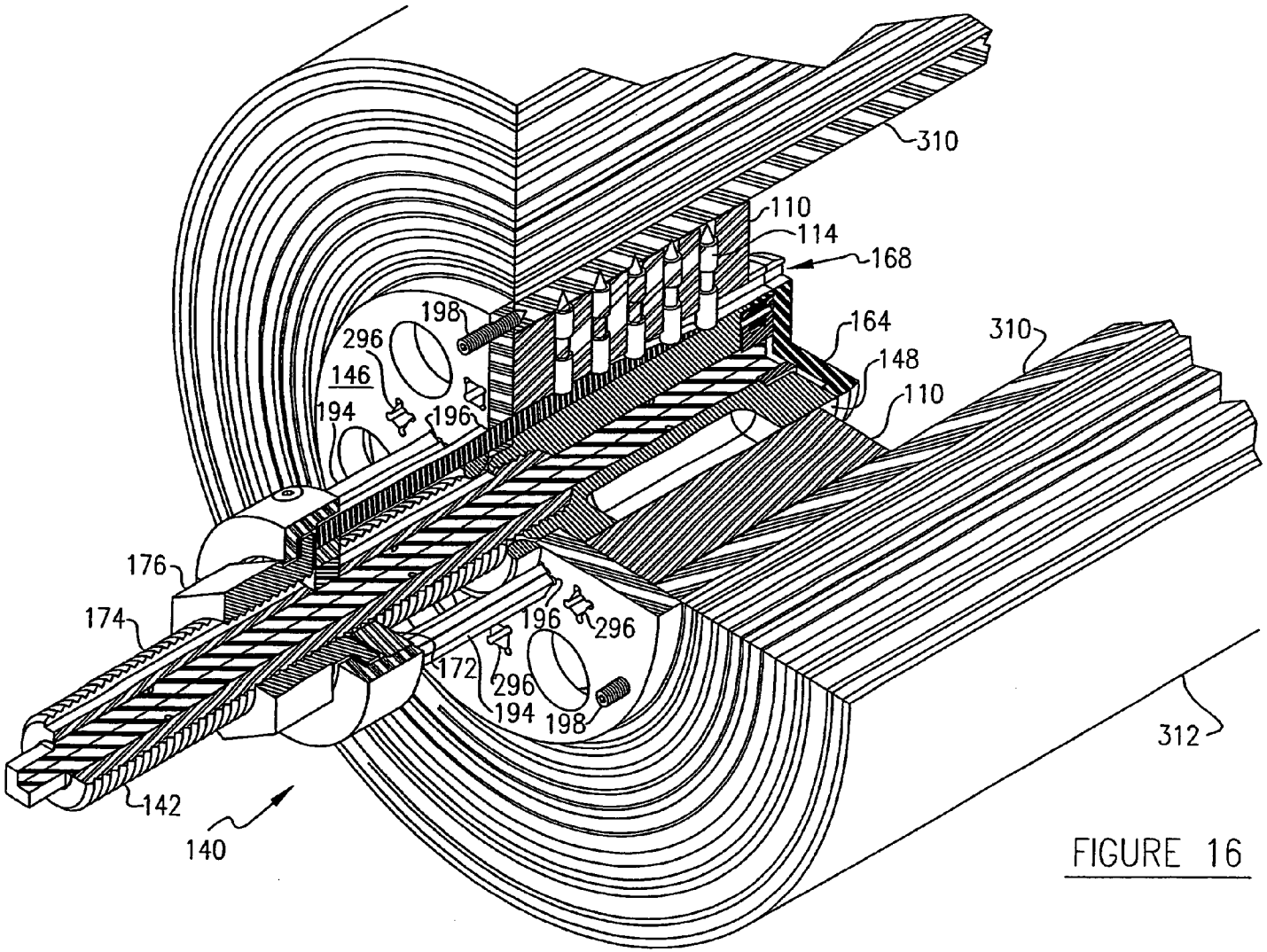
FIG. 16 is a partially sectioned isometric view of the FIG. 9 reusable adapter insertion tool engaging one end of a paper roll after insertion of a reusable core adapter into the roll's core and after actuation of the insertion tool to commence driving the reusable adapter's studs into the core.
Figure 18A:
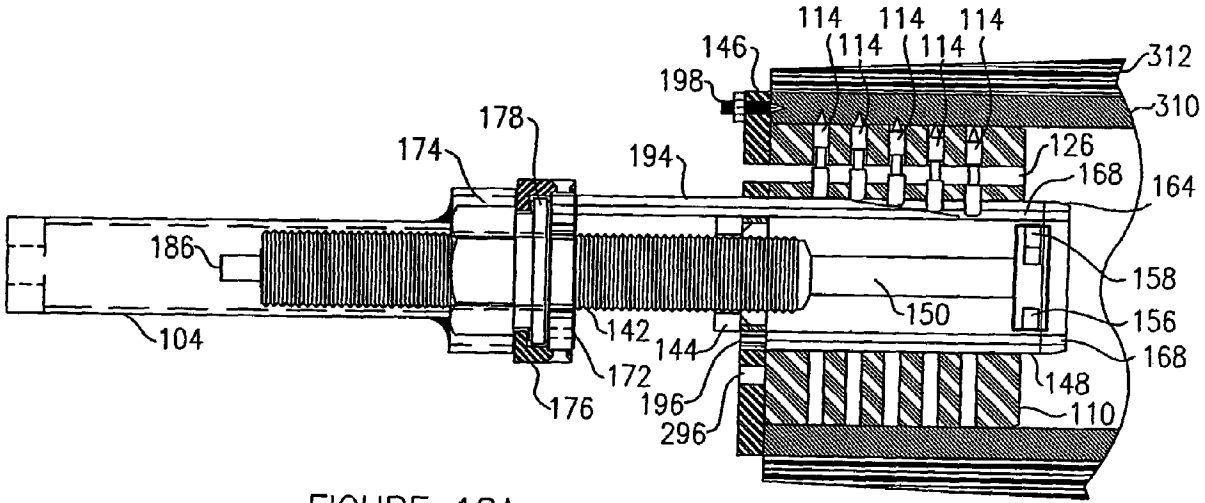
FIG. 18A is a schematic, partially sectioned, side elevation assembly view of the apparatus depicted in FIG. 16.

As shown in FIGS. 16 and 18A, the inward end of reusable core adapter insertion tool 140 (i.e. the end on which reusable core adapter 110 is captively mounted as aforesaid) is then inserted into one end of 6-inch paper roll core 310, until the inward face of stop flange 146 circumferentially surrounding adapter 110 is flush against the outward end of paper roll 312. This action forces the pointed tips of set screws 198 into core 310, preventing rotation of tool 140 and adapter 110 relative to core 310. Locking pins 156, 158 brace adapter 110's inward end, limiting the depth to which adapter 110 can be axially inserted into core 310—if adapter 310's outward end is inserted beyond the outward end of core 310 it could be difficult to remove adapter 110 from core 310. One end of a deep socket 104 is then fitted over drive nut 174. The socket's opposite end is coupled to an impact wrench (not shown). The impact wrench is actuated to rotate drive nut 174 so as to threadably advance drive nut 174 along rod 142 toward the rod's inward end (i.e. toward the right, as viewed in FIGS. 16 and 18A). Since drive nut 174's capture flange 178 is enclosed between drive flange 172 and keeper plate 176, such advancement of drive nut 174 advances drive flange 172 and keeper plate 176 along rod 142, toward the rod's inward end. More particularly, such advancement of drive nut 174 drives each one of bars 194 through a corresponding one of stop flange 146's apertures 196 and into a corresponding one of channels 168. The aforementioned engagement of key 182 within drive flange 172's keyway 183 and within rod 142's keyway 184 maintains alignment of drive flange 172 relative to stop flange 146 as bars 194 are driven into apertures 142.

When the wedge-tipped inward end of a bar 194 reaches the rounded bottom 118 of the outwardmost one of studs 114 within one of channels 168, the wedge tip slides easily beneath rounded bottom 118. As bar 194 is driven further into channel 168, the wedge tip is forced against rounded bottom 118, driving stud 114 substantially perpendicularly away from adapter 110's longitudinal axis 120. This in turn drives stud 114's tip 116 into core 310. Operation of the impact wrench is continued to simultaneously drive each bar 194 completely into a corresponding one of channels 168, until the inward face of drive flange 172 contacts the outward face of stop flange 146 (or spacer 144—if provided). The studs 114 in each row are thus successively driven into core 310, from the retracted position shown in FIG. 6 into the extended position shown in FIG. 7. This is shown in FIGS. 16 and 18A: the two outwardmost studs have been fully driven into core 310 and the three inwardmost studs are partially driven into core 310. Specifically, the central stud (i.e. the third stud from the left) is almost fully driven into core 310, the fourth stud from the left has initially penetrated core 310 and the inward end of the wedge tip of bar 194 has just reached the inwardmost stud to commence driving that stud into core 310. The studs' penetration depth into core 310 is determined by the width of bar 194, thus avoiding over-penetration of the studs which could distort the outer surface of core 310. As previously explained, within each row, each stud is coplanar with one stud in each one of the other rows. Accordingly, simultaneous driving of bars 194 into channels 168 successively drives each group of coplanar studs simultaneously into core 310, thereby maintaining concentric alignment of adapter 110 within core 310 to prevent off-axis rotation of core 310 during high speed unwinding of roll 312 wound from core 310. Longitudinal and transverse deflection of each bar 194 relative to its corresponding channel 168 is prevented since the wide base of each bar 194 is restrained within the wide, lower portion of the corresponding inverted-T cross-sectionally shaped channel 168.

After adapter 110 has been fully installed in core 310 (i.e. after all of studs 114 have been extended as shown in FIG. 7) the impact wrench is adjusted to reverse its drive direction, then actuated to rotate drive nut 174 so as to threadably retract drive nut 174 along rod 142 toward the rod's outward end, thereby retracting bars 194 along channels 168 until the bars' wedge tips clear adapter 110's outward face 122. A wrench is then used to rotate lock arm shaft 150's squared outward end 186 clockwise (as viewed from the left side of FIG. 16). Such rotation of lock arm shaft 150 rotates locking pin arm 152 clockwise (as viewed in FIGS. 11 and 12), moving locking pin arm 152 and locking pins 156, 158 into the position shown in FIG. 11 in which locking pins 56, 58 are retracted within mandrel 148. Reusable core adapter insertion tool 140 is then withdrawn from core 310, leaving reusable adapter 110 within core 310. Another reusable adapter 110 is then fitted onto tool 140 and inserted into the opposite end of core 310. That adapter's studs are then driven into the core 310 as described above.

When driven into core 310 as aforesaid, studs 114 robustly couple adapter 110 to core 310, so as to withstand core chuck axial thrust loads and resist acceleration and deceleration torques applied to paper roll 312 during typical operation of a press room reel stand. When the reel stand's core chucks (not shown—there are many different core chuck configurations) engage core 310, the core chuck's body butts against the underside of some or all rows of studs 114, preventing retraction of studs 114 from core 310 during unwinding of roll 312. Because reusable adapter 110's sleeve 112 is flangeless, no protrusions remain after adapter 110 is installed in core 310, so the width of paper roll 312 is unaffected by adapter 110. Paper rolls in which reusable adapters 110 have been installed can also be safely stacked on end. Reusable core adapter insertion tool 140 facilitates fast, efficient installation of reusable core adapters 110. Tool 140's simultaneous, symmetric radial engagement of studs 114 ensures concentric installation of each adapter 110 within core 310. Moreover, as explained below, adapter 110 is quickly and easily removed from the spent core after paper roll 312 is unwound.

Removal of Reusable Core Adapter

Figure 17:
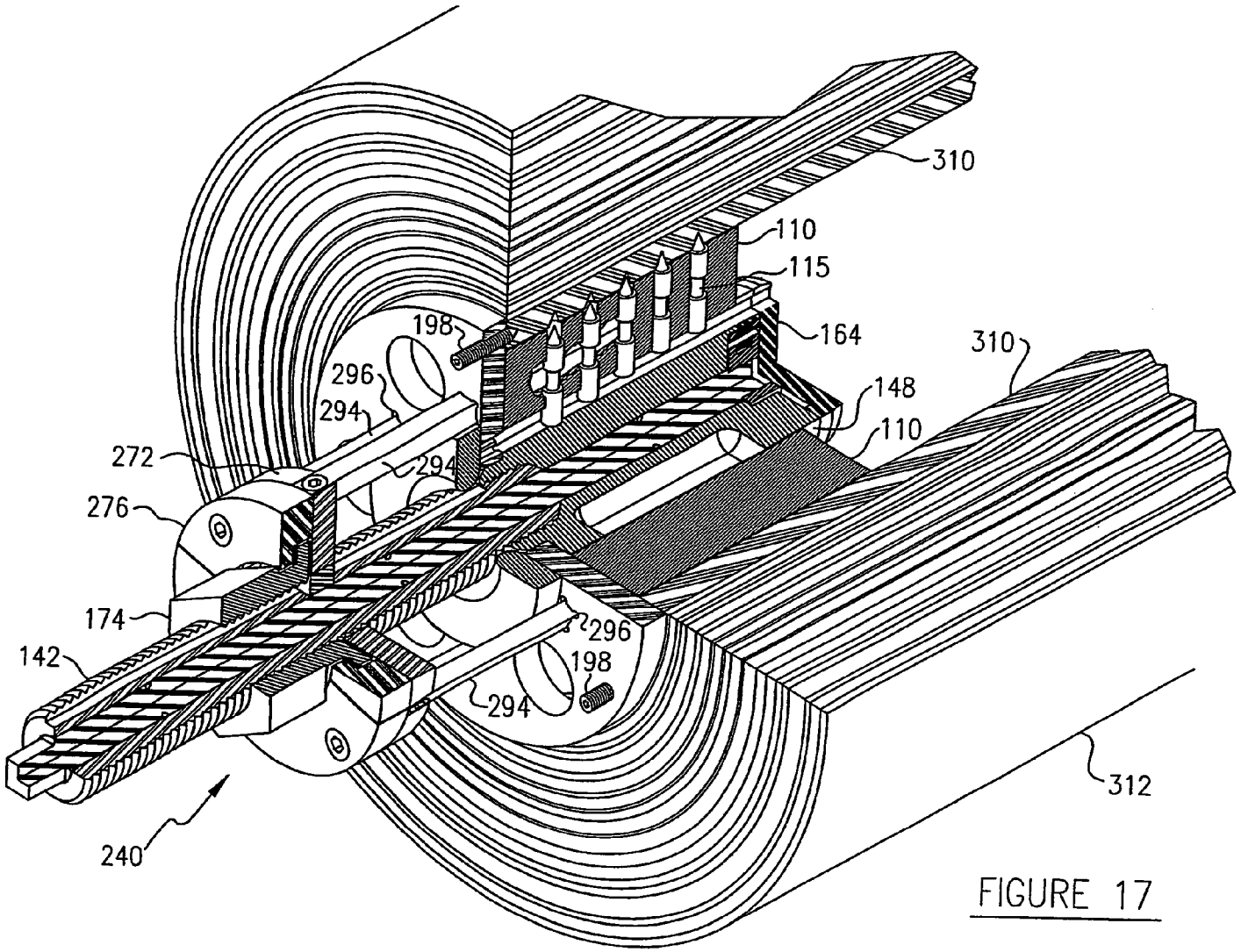
FIG. 17 is a partially sectioned isometric view of the FIG. 10 reusable adapter removal tool engaging one end of a paper roll core containing a previously inserted reusable core adapter, after actuation of the removal tool to commence withdrawal of the reusable adapter's studs from the core.
Figure 18B:
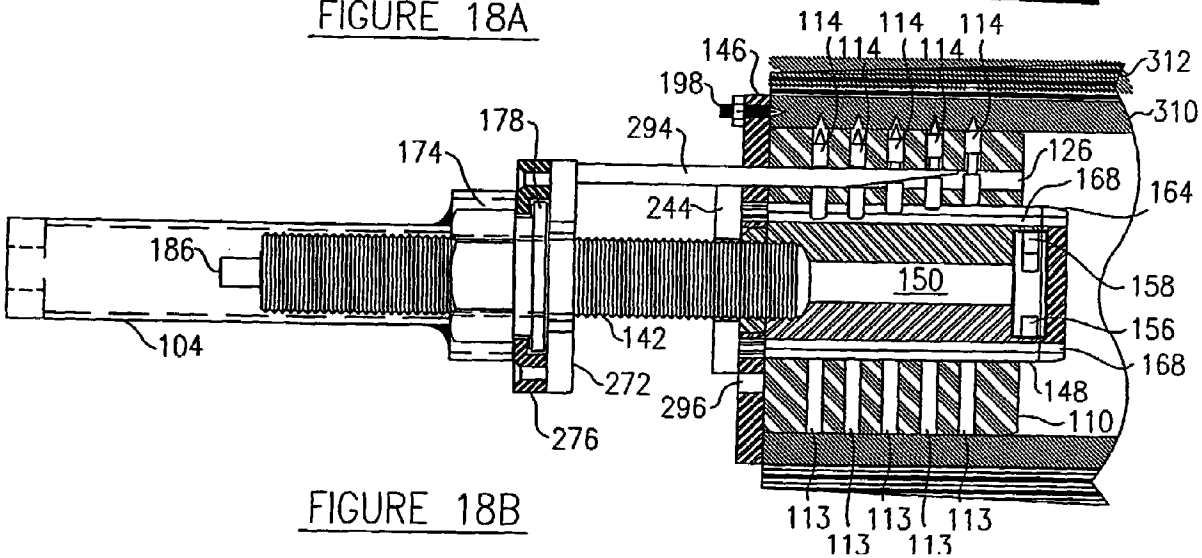
FIG. 18B is a schematic, partially sectioned, side elevation assembly view of the apparatus depicted in FIG. 17.

Reusable adapter 110 is removed from the spent core (or from a non-spent core, should such removal be necessary) with the aid of reusable core adapter removal tool 240, as shown in FIGS. 17 and 18B. A wrench is used to rotate lock arm shaft 150's squared outward end 186 clockwise (as viewed from the left side of FIGS. 17 and 18B). Such rotation of lock arm shaft 150 rotates locking pin arm 152 clockwise (as viewed in FIGS. 11 and 12), moving locking pin arm 152 and locking pins 156, 158 into the position shown in FIG. 11 in which locking pins 56, 58 are retracted within mandrel 148.

Mandrel 148 is then slidably advanced into the adapter's sleeve 112 until the inward face of stop flange 146 is flush against the adapter's outward end 122 (i.e. the end bearing "OUTSIDE" label 121), care being taken to align each one of stop flange 146's apertures 296 over a corresponding one of adapter 110's apertures 126. The wrench is then used to rotate lock arm shaft 150's squared outward end 186 counter-clockwise, moving locking pin arm 152 and locking pins 156, 158 into the position shown in FIG. 12 in which locking pins 156, 158 project from mandrel 148, thereby snugly capturing adapter 110 between stop flange 146 and locking pins 156, 158. This action forces the pointed tips of set screws 198 into core 310, preventing rotation of tool 240 and adapter 110 relative to core 310. The radiused edges of locking pins 156, 158 ease movement of the locking pins over adapter 110's inward end 124, reducing potential jamming of the locking pins against the adapter. The locking pins' wide, flat outward faces bear securely against the adapter's inward end, without indenting that end when the adapter is removed from core 310 as explained below.

One end of a deep socket 104 is then fitted over drive nut 174. The socket's opposite end is coupled to an impact wrench (not shown). The impact wrench is actuated to rotate drive nut 174 so as to threadably advance drive nut 174 along rod 142 toward the rod's inward end (i.e. toward the right, as viewed in FIGS. 17 and 18B). Since drive nut 174's capture flange 178 is enclosed between drive flange 272 and keeper plate 276, such advancement of drive nut 174 advances drive flange 272 and keeper plate 276 along rod 142, toward the rod's inward end. More particularly, such advancement of drive nut 174 drives each one of bars 294 through a corresponding one of stop flange 146's apertures 296 and into a corresponding one of adapter 110's apertures 126. The aforementioned engagement of key 182 within drive flange 272's keyway 283 (FIG. 14) and within rod 142's keyway 184 maintains alignment of drive flange 272 relative to stop flange 146 as bars 294 are driven into apertures 126.

FIGS. 7, 8A and 8B illustrate the extended position of studs 114 after insertion of adapter 110 into core 310 as explained above. As previously explained, each aperture 126 is located so that, when a corresponding row of studs 114 is extended from sleeve 112, the aperture 126 partially intersects the circumferential groove 115 of each stud in the row, without intersecting the bodies of any of the studs in the row. When the wedge-tipped inward end of a bar 294 reaches the groove 115 of the outwardmost one of studs 114 within one of apertures 126, the wedge tip slides easily over the groove's lower annular rim 117. As bar 294 is driven further into aperture 126, the wedge tip is forced against lower annular rim 117, driving stud 114 substantially perpendicularly toward adapter 110's longitudinal axis 120 and retracting stud 114's tip 116 from core 310. The tapered or conical shape of tip 116 facilitates such retraction.

Operation of the impact wrench is continued to simultaneously drive each bar 294 completely into a corresponding one of apertures 126, until the inward face of drive flange 272 contacts the outward face of stop flange 146 (or spacer 144—if provided). The studs 114 in each row are thus successively retracted from core 310 (i.e. studs 114 are driven from the extended position shown in FIG. 7 into the retracted position shown in FIG. 6). This is shown in FIGS. 17 and 18B: the two outwardmost studs have been fully retracted from core 310 and the central stud has been partially retracted from core 310.

After all of adapter 110's studs 114 have been retracted from core 310 the impact wrench is adjusted to reverse its drive direction, then actuated to rotate drive nut 174 so as to threadably retract drive nut 174 along rod 142 toward the rod's outward end, thereby retracting bars 294 from apertures 126 until the bars' wedge tips clear adapter 110's outward face 122. The inward end of tool 240, with reusable core adapter 110 captively mounted thereon, is then withdrawn from core 310. A wrench is then used to rotate lock arm shaft 150's squared outward end 186 clockwise (as viewed from the left side of FIG. 17). Such rotation rotates locking pin arm 152 clockwise (as viewed in FIGS. 11 and 12), moving locking pin arm 152 and locking pins 156, 158 into the position shown in FIG. 11 in which locking pins 56, 58 are retracted within mandrel 148. Reusable core adapter 110 is then slidably removed from mandrel 148.

As previously explained, disposable adapter 10 is ultimately discarded with the spent roll core. It is accordingly desirable that adapter 10 be as inexpensive as possible. For example, the number of studs 14 in adapter 10 is preferably minimized to reduce costs, without compromising the ability to robustly couple adapter 10 to a roll core. By comparison, reusable adapter 110 may be considerably more expensive than disposable adapter 10, and may have more studs than disposable adapter 10. As another example, disposable adapter 10's apertures 26 are cylindrical and thus more easily and inexpensively produced than reusable adapter 110's rectangular cross-sectioned apertures 126.

Since it is unnecessary to recover disposable adapter 10 from a spent roll core, studs 14 can be designed for secure, non-removable embedment within the roll core (i.e. a plug-like portion of the roll core is embedded within the hollow tip of each stud 14 as the stud is driven into the core). Such embedment reduces the depth to which each of adapter 10's studs preferably penetrates the roll core, that depth being about 0.200 inches (about 5 mm) for the above-described disposable adapter 10, when used with a standard 6-inch inside diameter paper roll core. By contrast, the stud penetration depth of the above-described reusable adapter 110 into a similar core may be about 0.300 inches (about 7.6 mm). This reflects the fact that the reusable adapter's studs are less securely (i.e. removably) embedded in the core, notwithstanding the fact that the above-described reusable adapter 110 has almost twice as many studs (30 vs. 18) as the above-described disposable adapter 10. This also reflects the fact that the reusable adapter's conical studs cause less distortion to the roll core and may therefore be more deeply embedded.

As will be apparent to those skilled in the art in the light of the foregoing disclosure, many alterations and modifications are possible in the practice of this invention without departing from the spirit or scope thereof. For example, channels 168 and bars 194 may have mating cross-sectional shapes other than an inverted-T shape; retention of bars 194 within channels 168 can be achieved with any cross-sectional shape which is wider along a radially inward portion of each bar and channel and narrower along a radially outward portion of each bar and channel. Accordingly, the scope of the invention is to be construed in accordance with the substance defined by the following claims.

What is claimed is:

1. Apparatus for installing a core adapter in a roll core, the apparatus comprising:

(a) a mandrel having an outside diameter slightly less than an inside diameter of a hollow cylindrical sleeve of the core adapter;

(b) a rod having an inward end coupled to an outward end of the mandrel;

(c) a stop flange mounted on the rod around the outward end of the mandrel;

(d) a drive flange mounted on the rod and displaceable along the rod toward the stop flange;

(e) a plurality of apertures in the stop flange, any one of the stop flange apertures coaxially alignable with any one of a corresponding plurality of longitudinal apertures formed through the sleeve of the core adapter;

(f) a plurality of wedge-tipped bars, each bar having:

(i) an inward tip insertable through one of the stop flange apertures into a corresponding one of the longitudinal apertures of the core adapter; and (ii) an outward end driveable by the drive flange.

2. Apparatus as defined in claim 1, further comprising:

(a) a shaft coaxially and rotatably friction-fit mounted in the rod, the shaft extending through the rod and through the mandrel;

(b) an arm coupled to an inward end of the shaft; and (c) at least one pin pivotally coupled to the arm;

wherein rotation of the rod in a first direction retracts the pin within the mandrel and rotation of the rod in a second direction opposite to the first direction projects the pin from the mandrel.

3. Apparatus as defined in claim 2, further comprising, for each one of the bars, a set screw mounted on the drive flange and adjustable to fix a displacement between the drive flange and the outward end of one of the bars.

4. Apparatus as defined in claim 3, wherein each one of the set screws is coaxially aligned with one of the stop flange apertures.

5. Apparatus as defined in claim 4, wherein each one of the bars and each one of the stop flange apertures is hexagonally cross-sectioned.

6. Apparatus as defined in claim 5, wherein the outward end of each one of the bars is recessed to receive one of the set screws.

7. Apparatus for installing a core adapter in a roll core, the apparatus comprising:

(a) a mandrel having:

(i) an outside diameter slightly less than an inside diameter of a hollow cylindrical sleeve of the core adapter;

(ii) a plurality of circumferentially spaced, longitudinally extending channels, each channel for slidably receiving the bottoms of one longitudinally aligned row of studs in the core adapter;

(b) a rod having an inward end coupled to an outward end of the mandrel;

(c) a stop flange mounted on the rod around the outward end of the mandrel;

(d) a drive flange mounted on the rod and displaceable along the rod toward the stop flange;

(e) a plurality of apertures in the stop flange, each stop flange aperture coaxially aligned with one of the mandrel channels;

(f) a plurality of wedge-tipped bars, each bar having:

(i) an inward tip insertable through one of the stop flange apertures into a corresponding one of the mandrel channels; and (ii) an outward end fixed to the drive flange.

8. Apparatus as defined in claim 7, further comprising:

(a) a shaft coaxially and rotatably friction-fit mounted in the rod, the shaft extending through the rod and through the mandrel;

(b) an arm coupled to an inward end of the shaft; and (c) at least one pin pivotally coupled to the arm;

wherein rotation of the rod in a first direction retracts the pin within the mandrel and rotation of the rod in a second direction opposite to the first direction projects the pin from the mandrel.

9. Apparatus as defined in claim 8, wherein the bars and channels have a mating cross-sectional shape, the shape being wider along a radially inward portion of each bar and channel and narrower along a radially outward portion of each bar and channel.

10. Apparatus as defined in claim 9, wherein each bar is fixed to the drive flange with a sloped wedge surface of the bar facing radially toward a circumferential rim of the drive flange.

11. Apparatus for removing a core adapter from a roll core, the apparatus comprising:

(a) a mandrel having an outside diameter slightly less than an inside diameter of a hollow cylindrical sleeve of the core adapter;

(b) a rod having an inward end coupled to an outward end of the mandrel;

(c) a stop flange mounted on the rod around the outward end of the mandrel;

(d) a drive flange mounted on the rod and displaceable along the rod toward the stop flange;

(e) a plurality of apertures in the stop flange, any one of the stop flange apertures coaxially alignable with any one of a corresponding plurality of longitudinal apertures formed through the sleeve of the core adapter;

(f) a plurality of wedge-tipped bars, each bar having:

(i) an inward tip insertable through one of the stop flange apertures into a corresponding one of the longitudinal apertures of the core adapter; and (ii) an outward end fixed to the drive flange.

12. Apparatus as defined in claim 11, further comprising:

(a) a shaft coaxially and rotatably friction-fit mounted in the rod, the shaft extending through the rod and through the mandrel;

(b) an arm coupled to an inward end of the shaft; and (c) at least one pin pivotally coupled to the arm;

wherein rotation of the rod in a first direction retracts the pin within the mandrel and rotation of the rod in a second direction opposite to the first direction projects the pin from the mandrel.

13. Apparatus as defined in claim 12, wherein each bar is fixed to the drive flange with a sloped wedge surface of the bar facing radially away from a circumferential rim of the drive flange.

* * * * *